US012648616B2

(12) United States Patent
Chang et al.

(10) Patent No.: US 12,648,616 B2
(45) Date of Patent: Jun. 9, 2026

(54) SOLE STRUCTURE FOR ARTICLE OF FOOTWEAR

(71) Applicant: NIKE, Inc., Beaverton, OR (US)

(72) Inventors: Leo S. Chang, Portland, OR (US); Jeremy L. Connell, Hillsboro, OR (US); Karen S. Dimoff, Portland, OR (US); Thea Moshofsky, Beaverton, OR (US); Rachel M. Savage, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 166 days.

(21) Appl. No.: 18/049,014

(22) Filed: Oct. 24, 2022

(65) Prior Publication Data

US 2023/0127595 A1 Apr. 27, 2023

Related U.S. Application Data

(60) Provisional application No. 63/329,558, filed on Apr. 11, 2022, provisional application No. 63/271,597, filed on Oct. 25, 2021.

(51) Int. Cl.

| | |
|---|---|
| ***A43B 13/18*** | (2006.01) |
| ***A43B 7/148*** | (2022.01) |
| ***A43B 7/1485*** | (2022.01) |

(52) U.S. Cl.

CPC ..... *A43B 13/187* (2013.01); *A43B 7/148* (2013.01); *A43B 7/1485* (2013.01)

(58) Field of Classification Search

USPC ..... 36/29

See application file for complete search history.

(56) References Cited

U.S. PATENT DOCUMENTS

| | | | | |
|---|---|---|---|---|
| 5,313,717 | A | 5/1994 | Allen et al. | |
| 5,713,141 | A | 2/1998 | Mitchell et al. | |
| 5,771,606 | A | 6/1998 | Litchfield et al. | |
| 5,952,065 | A | 9/1999 | Mitchell et al. | |
| 6,582,786 | B1 | 6/2003 | Bonk et al. | |
| 2003/0208930 | A1 | 11/2003 | Swigart | |
| 2011/0035966 | A1 * | 2/2011 | Geer | A43B 13/36 36/76 R |
| 2013/0139410 | A1 * | 6/2013 | Dirsa | A43B 13/188 36/103 |

(Continued)

FOREIGN PATENT DOCUMENTS

WO WO-2021101964 A1 5/2021

OTHER PUBLICATIONS

European Patent Office (ISA), International Search Report and Written Opinion for PCT App. No. PCT/US2022/078625, mailed Feb. 14, 2023.

*Primary Examiner* — Matthew R Marchewka

(74) *Attorney, Agent, or Firm* — Honigman LLP; Matthew H. Szalach; Jonathan P. O'Brien

(57) ABSTRACT

A sole structure for an article of footwear includes a first cushioning member extending continuously from an anterior end of the sole structure to a posterior end of the sole structure. The first cushioning member includes an upper side, a bottom side formed on an opposite side from the upper side, and a recess formed in the upper side. A first bladder is disposed within the recess adjacent to a lateral side of the sole structure and a second bladder is disposed within the recess adjacent to a medial side of the sole structure.

20 Claims, 21 Drawing Sheets

(56) References Cited

U.S. PATENT DOCUMENTS

| | | | | |
|---|---|---|---|---|
| 2014/0026441 | A1* | 1/2014 | Stauffer | A43B 13/184 36/103 |
| 2014/0245640 | A1* | 9/2014 | Heard | A43B 3/0052 36/88 |
| 2016/0058123 | A1* | 3/2016 | Peyton | A43B 13/141 36/25 R |
| 2018/0213886 | A1* | 8/2018 | Connell | A43B 13/12 |
| 2020/0037705 | A1* | 2/2020 | Frank | A43B 13/125 |
| 2020/0205514 | A1* | 7/2020 | VanDomelen | A43B 13/188 |
| 2020/0281312 | A1* | 9/2020 | Connell | A43B 13/148 |
| 2020/0305551 | A1 | 10/2020 | Campos, II et al. | |

* cited by examiner 134
116
126
120
140
182
184
186
110
180
100
144
146
150
108
108
172
174
164
170
175
148
128
120
118
162
158
170
160
104

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/329,558, filed on Apr. 11, 2022, and to U.S. Provisional Application No. 63/271,597, filed on Oct. 25, 2021. The disclosures of these prior applications are considered part of the disclosure of this application and are hereby incorporated by reference in their entirety.

FIELD

The present disclosure relates generally to an article of footwear and, more particularly, to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
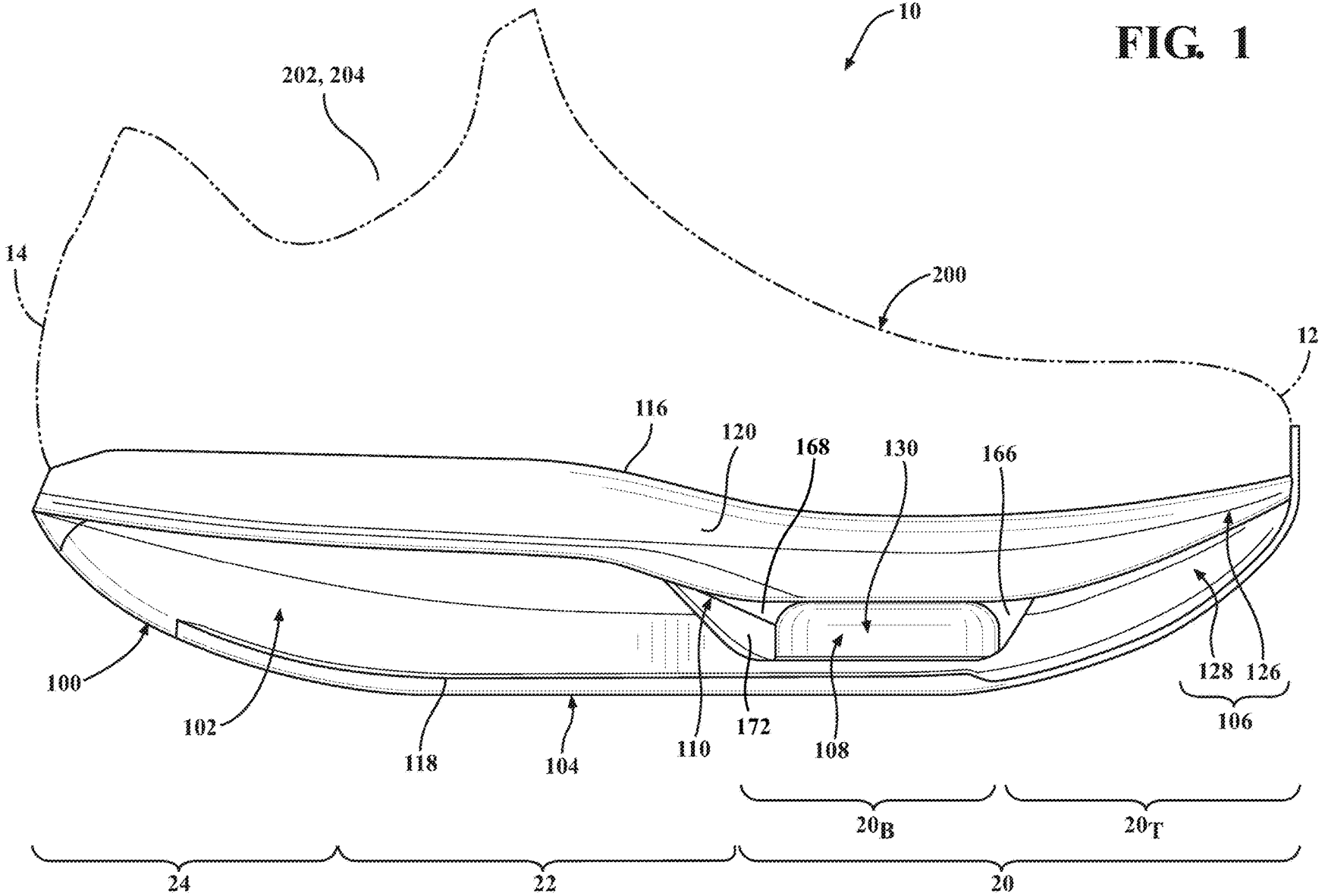
FIG. 1 is a lateral side view of a sole structure for an article of footwear according to an example of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

An aspect of the disclosure provides a sole structure for an article of footwear. The sole structure includes a first cushion extending continuously from an anterior end of the sole structure to a posterior end of the sole structure and includes an upper side, a bottom side formed on an opposite side from the upper side, and a recess formed in the upper side. The sole structure further includes a first bladder disposed within the recess adjacent to a lateral side of the sole structure and a second bladder disposed within the recess adjacent to a medial side of the sole structure.

Implementations of the disclosure may include one or more of the following optional features. In some examples, the recess extends across an entire width of the first cushion from the medial side to the lateral side. In some configurations, the recess is disposed in a forefoot region of the first cushion.

In some implementations, the recess extends from a first end surface adjacent to a toe portion of the sole structure to a second end surface disposed in a mid-foot region of the sole structure. Here, at least one of the first end surface or the second end surface may be spaced apart from each of the first bladder and the second bladder. In some examples, at least one of the first end surface and the second end surface is oriented at an oblique angle relative to a central axis of the first bladder. In some configurations, the first end surface is oriented at a first oblique angle relative to the central axis of the first bladder and the second end surface is oriented at a second oblique angle relative to the central axis.

In some examples, the sole structure includes a second cushion extending from the anterior end to the posterior end and having a top side and a lower side formed on an opposite side of the second cushion than the top side, the lower side facing the upper side of the first cushion. In some configurations, the sole structure includes a plate disposed adjacent to the lower side and including a first plate portion attached to the first cushion in a toe portion, a second plate portion extending across the recess and attached to each of the first bladder and the second bladder, and a third plate portion attached to the first cushion in a mid-foot region of the sole structure. In some examples, the first bladder and the second bladder each include a tensile member.

Another aspect of the disclosure provides a sole structure for an article of footwear. The sole structure includes a cushion extending continuously from an anterior end of the sole structure to a posterior end of the sole structure and includes a top side, a bottom side formed on an opposite side from the top side, and a receptacle disposed between the top side and the bottom side. The sole structure further includes a first bladder disposed within the receptacle adjacent to a lateral side of the sole structure and a second bladder disposed within the receptacle adjacent to a medial side of the sole structure.

This aspect of the disclosure may include one or more of the following optional features. In some example, the receptacle extends across an entire width of the cushion from the medial side to the lateral side. In some configurations, the receptacle is disposed in a forefoot region of the cushion.

In some implementations, the receptacle extends from a first end surface adjacent to a toe portion of the sole structure to a second end surface disposed in one of a forefoot region or a mid-foot region of the sole structure. In some examples, at least one of the first end surface or the second end surface is spaced apart from each of the first bladder and the second bladder. Optionally, at least one of the first end surface and the second end surface is oriented at an oblique angle relative to a central axis of the first bladder. In some examples, the first end surface is oriented at a first oblique angle relative to the central axis of the first bladder and the second end surface is oriented at a second oblique angle relative to the central axis.

In some configurations, the cushion includes a first cushion including a recess and a second cushion covering the recess to define the receptacle. In some implementations, the sole structure includes a plate including a first plate portion attached to the cushion in a toe portion, a second plate portion extending across the receptacle and attached to each of the first bladder and the second bladder, and a third plate portion attached to the cushion in a mid-foot region of the sole structure. In some examples, the first bladder and the second bladder each include a tensile member.

Figure 7:
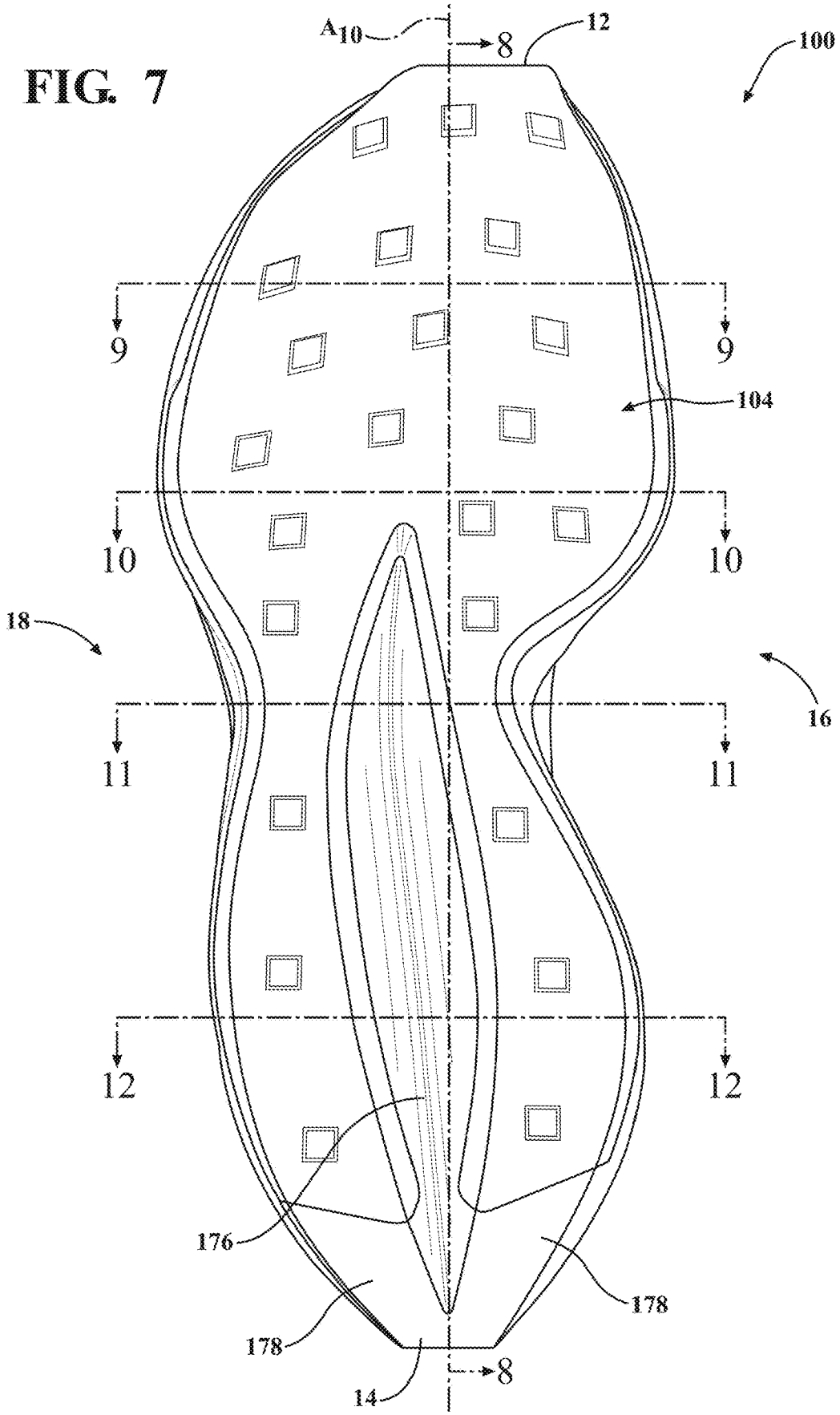
FIG. 7 is a bottom plan view of the sole structure of FIG. 1.

Referring to FIGS. 1-12, an article of footwear 10 includes a sole structure 100 and an upper 200 attached to the sole structure 100. The footwear 10 may further include an anterior end 12 associated with a forward-most point of the footwear 10, and a posterior end 14 corresponding to a rearward-most point of the footwear 10. As shown in FIG. 7, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges and a ball portion $\mathbf{20}_B$ associated with metatarsal bones of a foot. The mid-foot region 22 may correspond with an arch area of the foot, and the heel region 24 may correspond with rear portions of the foot, including a calcaneus bone.

The sole structure 100 includes midsole 102 configured to provide cushioning and support and an outsole 104 defining a ground-engaging surface (i.e., contacts the ground during a stance phase of a gait cycle) of the sole structure 100. Unlike conventional sole structures, which include monolithic midsoles and outsoles, the sole structure 100 of the present disclosure is configured as a composite structure including a plurality of components joined together. For example, the midsole 102 includes a resilient cushion or cushioning element 106, one or more bladders 108, and a plate 110. The outsole 104 is attached to the midsole 102 to provide traction and abrasion resistance.

Figure 2:
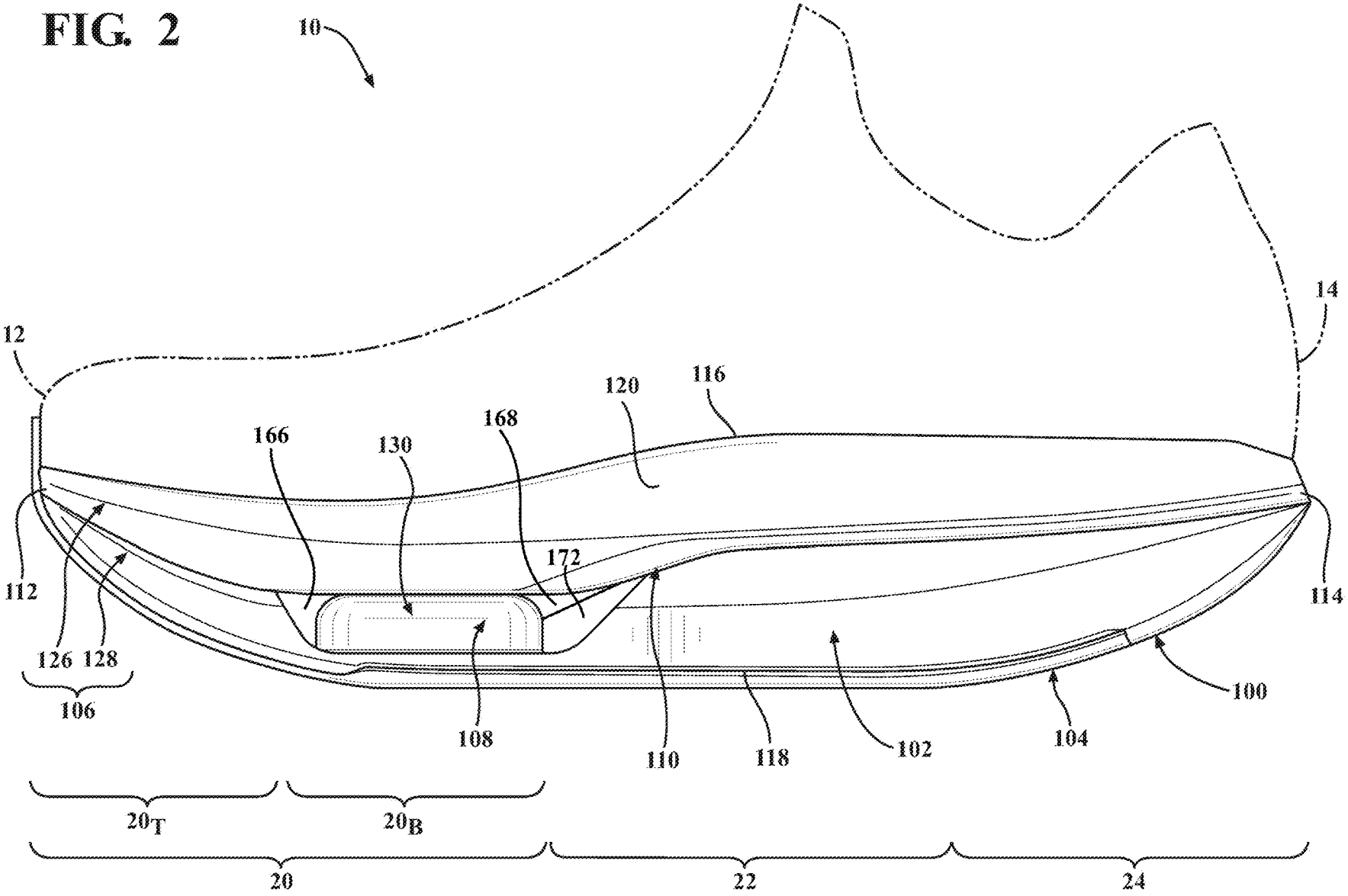
FIG. 2 is a medial side view of the sole structure of FIG. 1.

With reference to FIGS. 1 and 2, the cushioning element 106 of the midsole 102 extends from a first end 112 at the anterior end 12 of the footwear 10 to a second end 114 at the posterior end 14 of the footwear 10. The cushioning element 106 further includes a top side 116 facing the upper 200 and defining a profile of a footbed of the sole structure 100, a bottom side 118 formed on an opposite side of the cushioning element 106 from the top side 116 and defining a profile of the ground-contacting surface of the sole structure 100, and a peripheral side 120 extending from the top side 116 to the bottom side 118 and defining an outer peripheral profile of the sole structure 100.

While the cushioning element 106 may be formed as a monolithic structure including a homogenous elastomeric material, the cushioning element 106 of the present example is defined in terms of a plurality of portions or subcomponents. For example, the cushioning element 106 includes an upper cushion or cushioning member 126 disposed adjacent to the upper 200 and a lower cushion or cushioning member 128 disposed adjacent to the outsole 104. Each of the upper cushioning member 126 and the lower cushioning member 128 extends continuously from the first end 112 of the cushioning element 106 to the second end 114 of the cushioning element 106.

As described in greater detail below, the cushioning element 106 includes a receptacle 130 formed within the cushioning element 106 between the top side 116 and the bottom side 118 in the forefoot region 20. The receptacle 130 is configured to receive and support the one or more bladders 108 within the cushioning element 106. In other words, the cushioning element 106 extends above the bladders 108 (i.e., between the bladders 108 and the upper 200) and beneath the bladders 108 (i.e., between the bladders 108 and the outsole 104).

Figure 3:
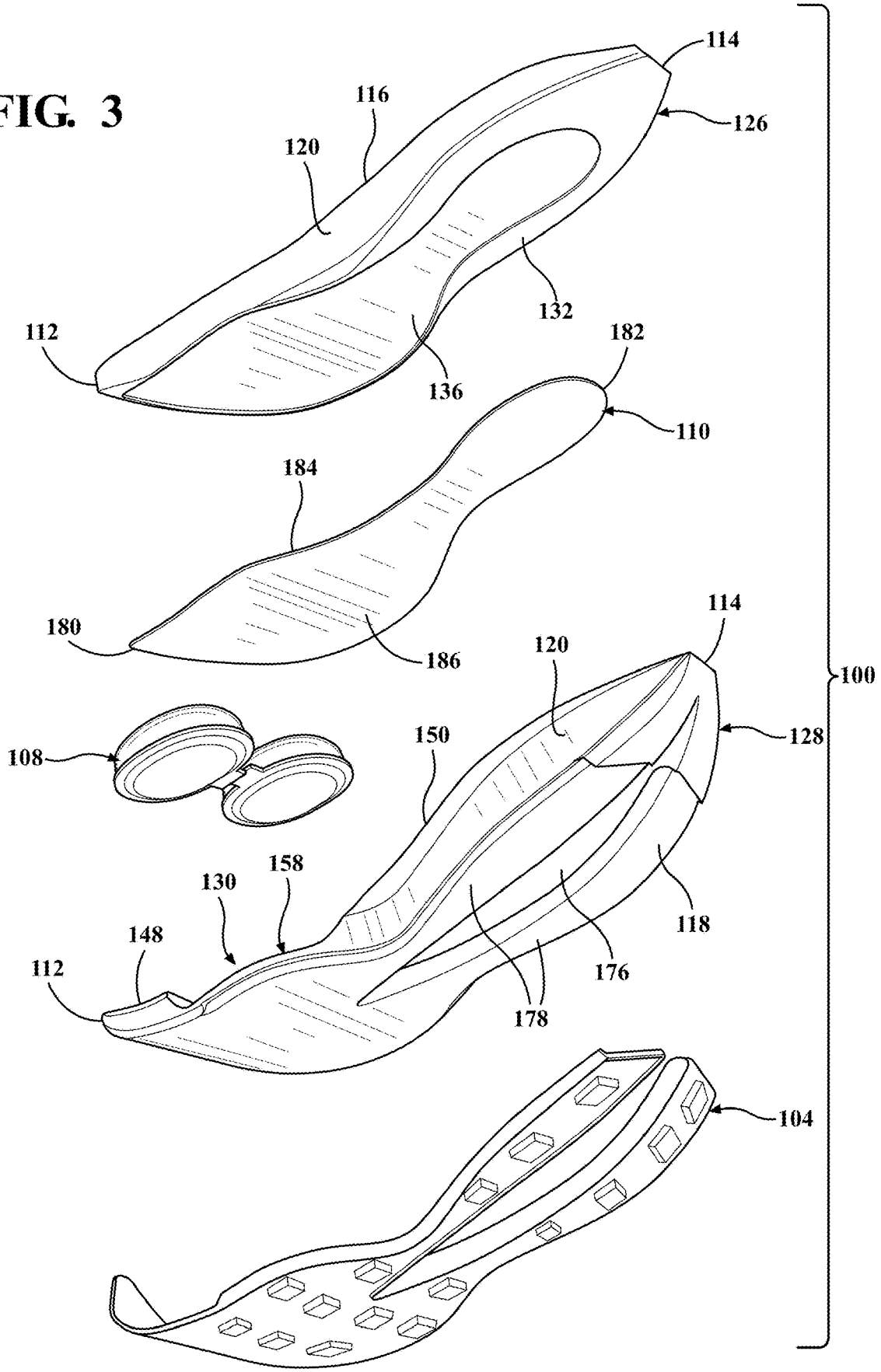
FIG. 3 is an exploded bottom perspective view of the sole structure of FIG. 1.
Figure 4:
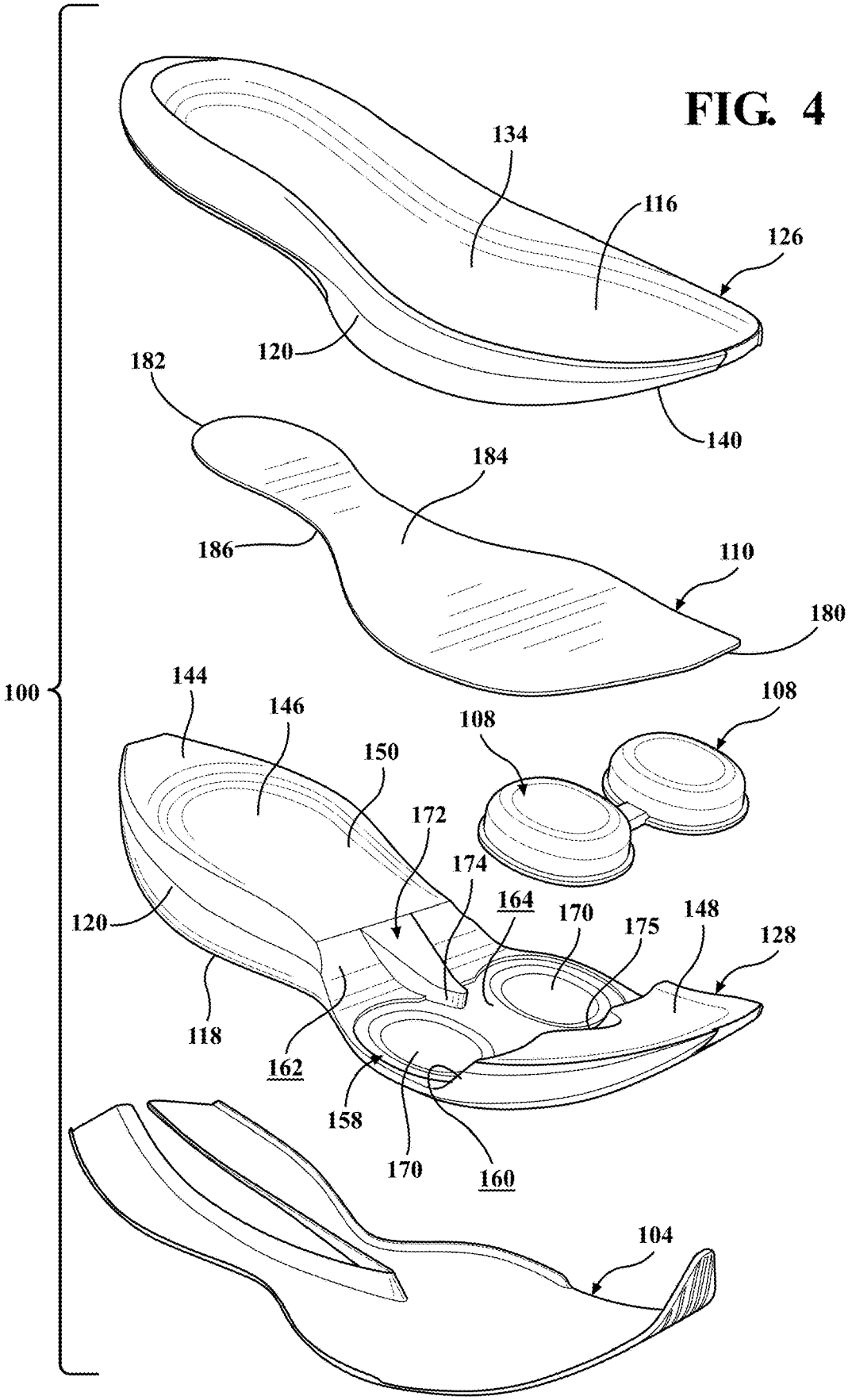
FIG. 4 is an exploded top perspective view of the sole structure of FIG. 1.
Figure 5:
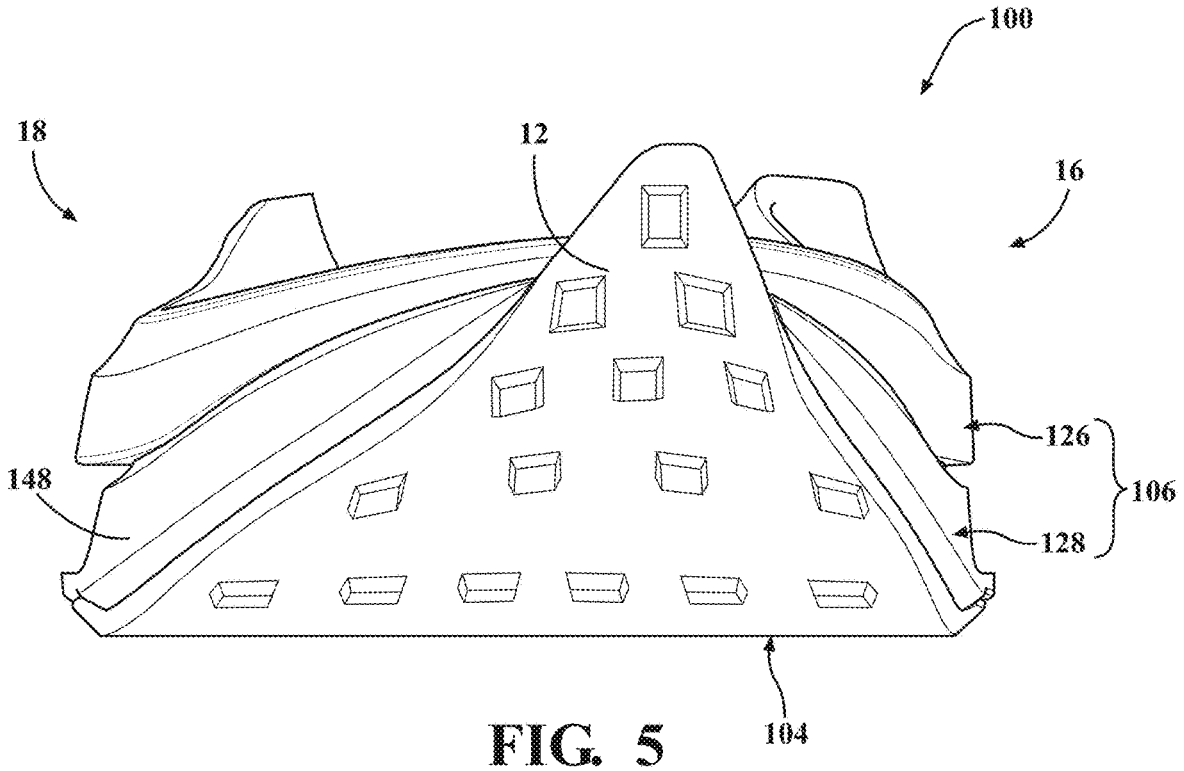
FIG. 5 is a front elevation view of the sole structure of FIG. 1.
Figure 6:
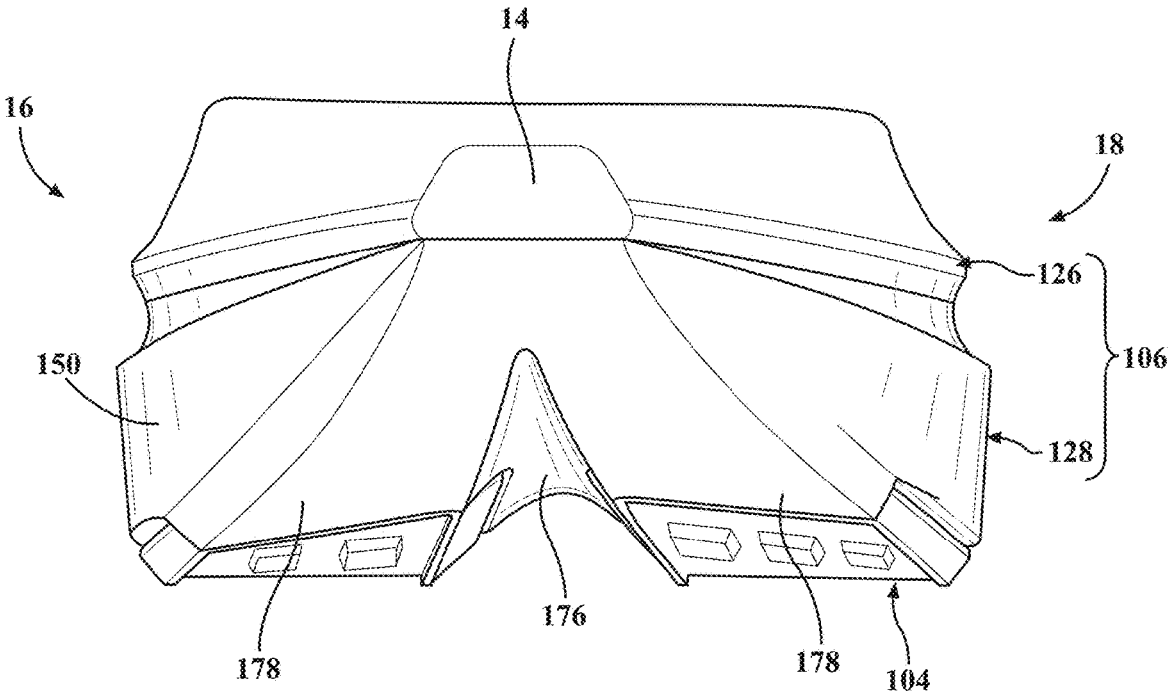
FIG. 6 is a rear elevation view of the sole structure of FIG. 1.

Referring now to FIGS. 3-9, the upper cushioning member 126 extends continuously from the first end 112 of the cushioning element 106 to the second end 114 of the cushioning element 106. The upper cushioning member 126 includes the top side 116 of the cushioning element 106 and a lower side 132 formed on an opposite side of the upper cushioning member 126 than the top side 116. An upper portion of the peripheral side 120 connects the top side 116 to the lower side 132 and defines an outer peripheral profile of the upper cushioning member 126. As shown in FIG. 3, the top side 116 of the upper cushioning member 126 defines the footbed 134 of the sole structure 100. As shown in FIG. 4, the lower side 132 of the upper cushioning member 126 includes an upper plate pocket 136 configured to receive an upper portion of the plate 110 when the sole structure 100 is assembled.

Referring still to FIGS. 3-9, the lower cushioning member 128 extends continuously from the first end 112 of the cushioning element 106 to the second end 114 of the cushioning element 106. The lower cushioning member 128 may be described as including the bottom side 118 of the cushioning element 106 and an upper side 144 formed on an opposite side of the lower cushioning member 128 than the bottom side 118. A lower portion of the peripheral side 120 connects the bottom side 118 and the upper side 144 and defines an outer peripheral profile of the lower cushioning member 128. When the sole structure 100 is assembled, the upper side 144 of the lower cushioning member 128 faces and is attached to the lower side 132 of the upper cushioning member 126 to form the cushioning element 106.

The upper side 144 of the lower cushioning member 128 may optionally include a lower plate pocket 146 configured to receive a lower portion of the plate 110 when the sole structure 100 is assembled. Because the lower cushioning member 128 may include the receptacle 130 formed in the upper side 144, a first portion of the lower pocket 146 may be formed in the upper side 144 in the toe portion $\mathbf{20}_T$ and a second portion of the lower pocket 146 may be formed in the upper side 144 in the mid-foot region 22 and the heel region 24. Thus, when the sole structure 100 is assembled, a top portion of the plate 110 is received within the upper plate pocket 136 formed in the lower side 132 of the upper cushioning member 126 and a bottom portion of the plate 110 is received within the portions of the lower plate pocket 146 formed in the upper side 144 of the lower cushioning member 128. Here, the lower portion of the plate 110 may be exposed within the receptacle 130 between the portions of the lower plate pocket 146 formed in the toe portion $\mathbf{20}_T$ and the mid-foot region 22.

Although the lower cushioning member 128 is formed as a continuous structure extending from the first end 112 to the second end 114, the lower cushioning member 128 may be described as including an anterior support segment 148 disposed adjacent to the first end 112, a posterior support segment 150 disposed adjacent to the second end 114, and a tray 158 connecting the anterior support segment 148 and the posterior support segment 150. The anterior support segment 148 and the posterior support segment 150 each define a first thickness $T_{128\text{-}1}$ of the lower cushioning member 128 extending from the bottom side 118 to the upper side 144 and the tray 158 defines a second thickness $T_{128\text{-}2}$ that is less than the first thickness $T_{128\text{-}1}$ in the ball portion $\mathbf{20}_B$ of the lower cushioning member 128. Accordingly, the different thicknesses $T_{128\text{-}1}$, $T_{128\text{-}2}$ of the lower cushioning member 128 cooperate to define the receptacle 130 in the ball portion $\mathbf{20}_B$ of the lower cushioning member 128.

As shown, the receptacle 130 of the sole structure 100 extends along the direction of the longitudinal axis $A_{10}$ from a first end surface 160 to a second end surface 162 that faces the first end surface 160. Thus, the first end surface 160 defines a posterior end of the anterior support segment 148 and the second end surface 162 defines an anterior end of the posterior support segment 150. The receptacle 130 is further defined by a recessed support surface 164 connecting the first end surface 160 and the second end surface 162. In the illustrated example, each of the surfaces 160, 162, 164 extends continuously through an entire width of the midsole 102 from the medial side 16 to the lateral side 18 such that the receptacle 130 effectively forms a channel extending across the width of the sole structure 100.

Figure 8:
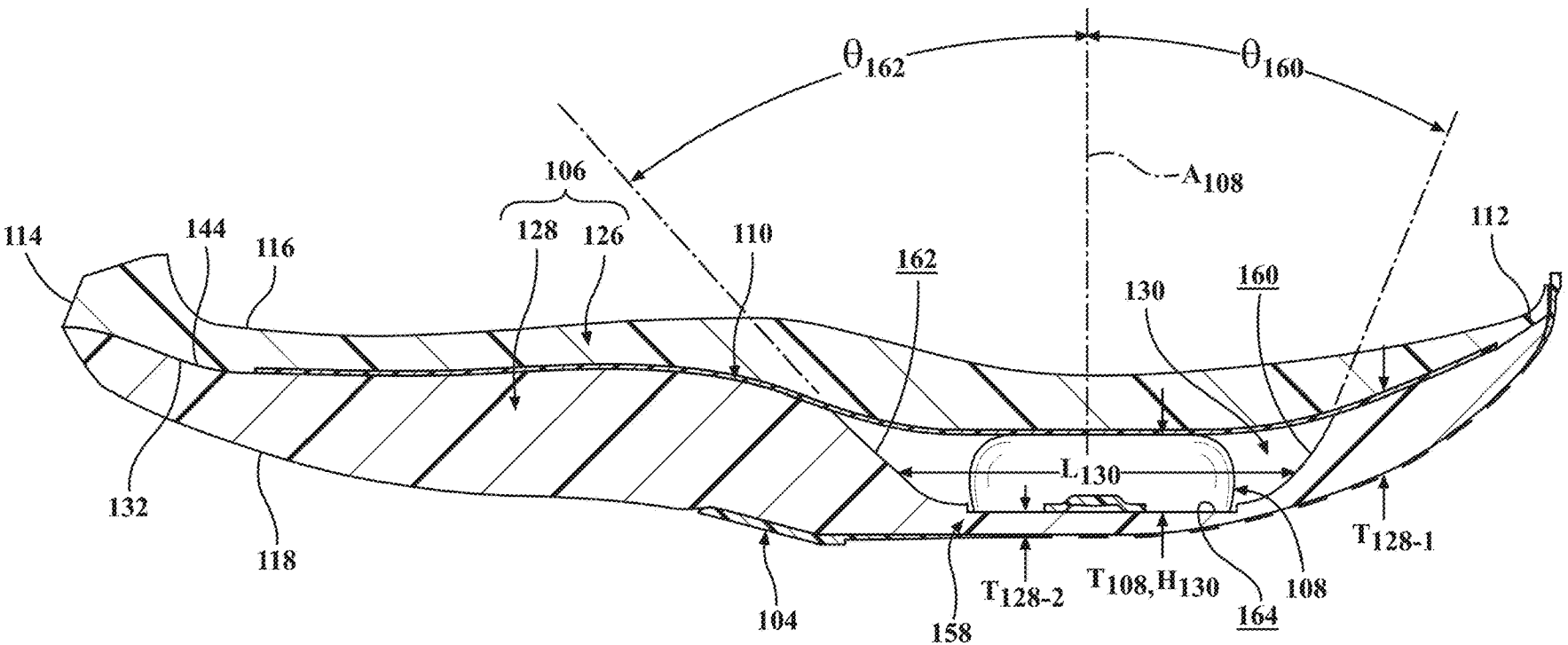
FIG. 8 is a cross-sectional view of the sole structure of FIG. 1, taken along Line 8-8 in FIG. 7.
Figure 9:
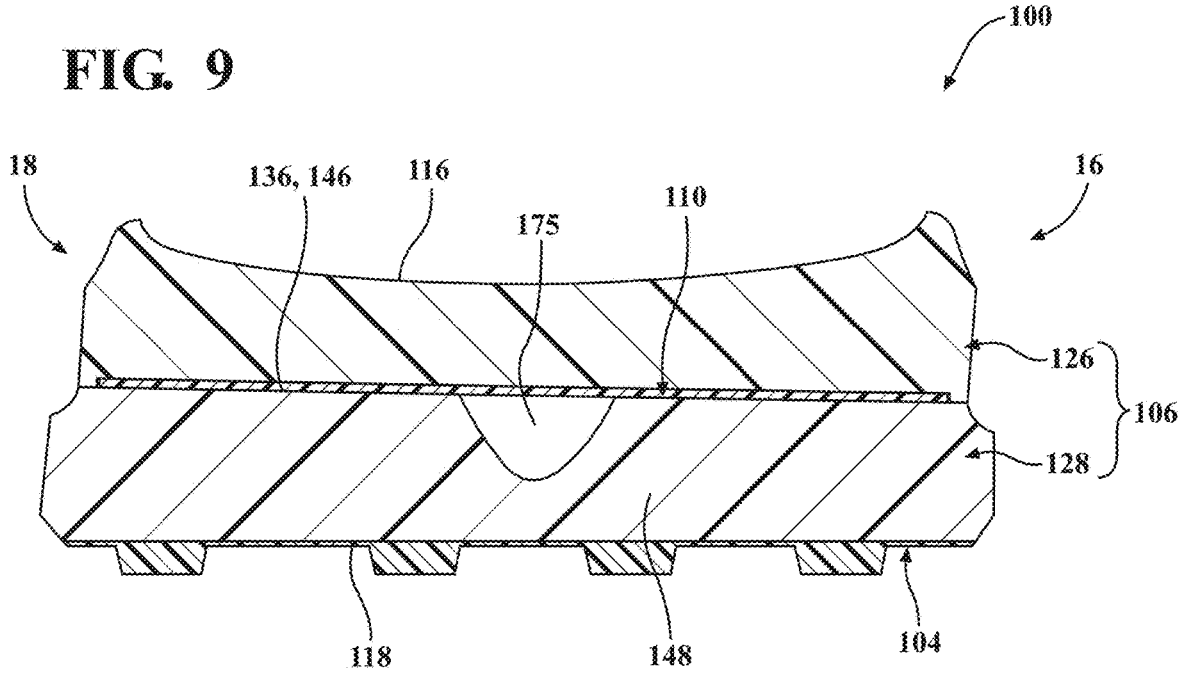
FIG. 9 is a cross-sectional view of the sole structure of FIG. 1, taken along Line 9-9 in FIG. 7.
Figure 10:
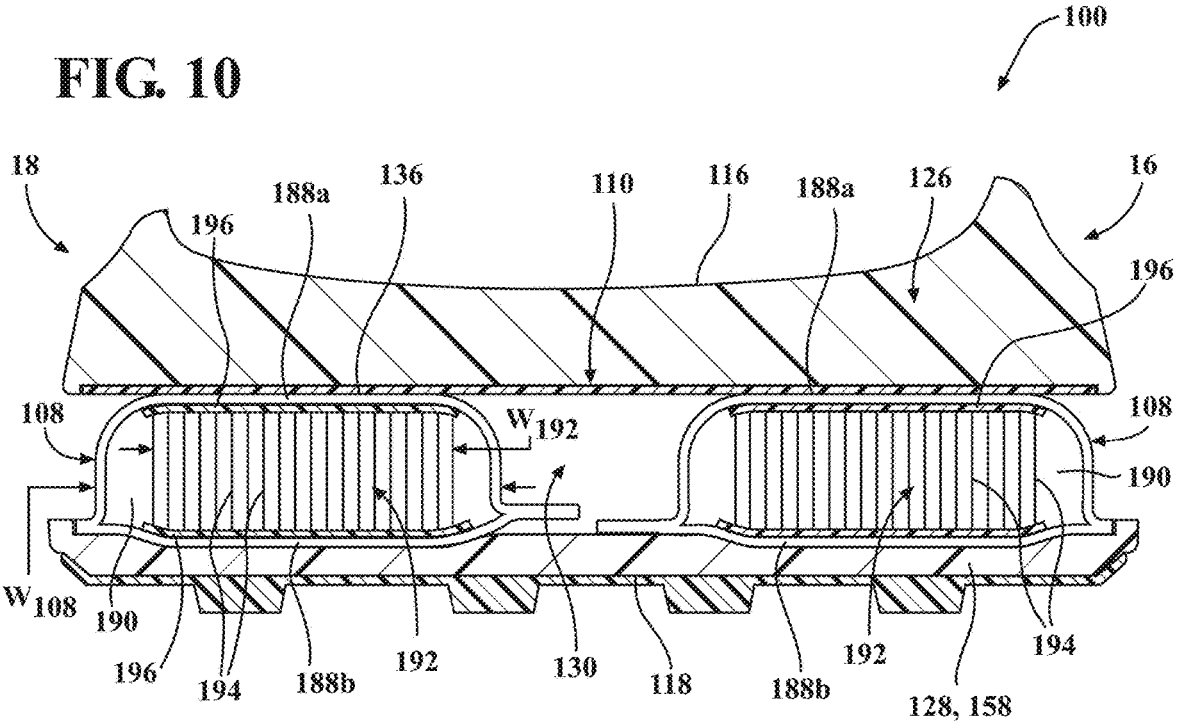
FIG. 10 is a cross-sectional view of the sole structure of FIG. 1, taken along Line 10-10 in FIG. 7.
Figure 11:
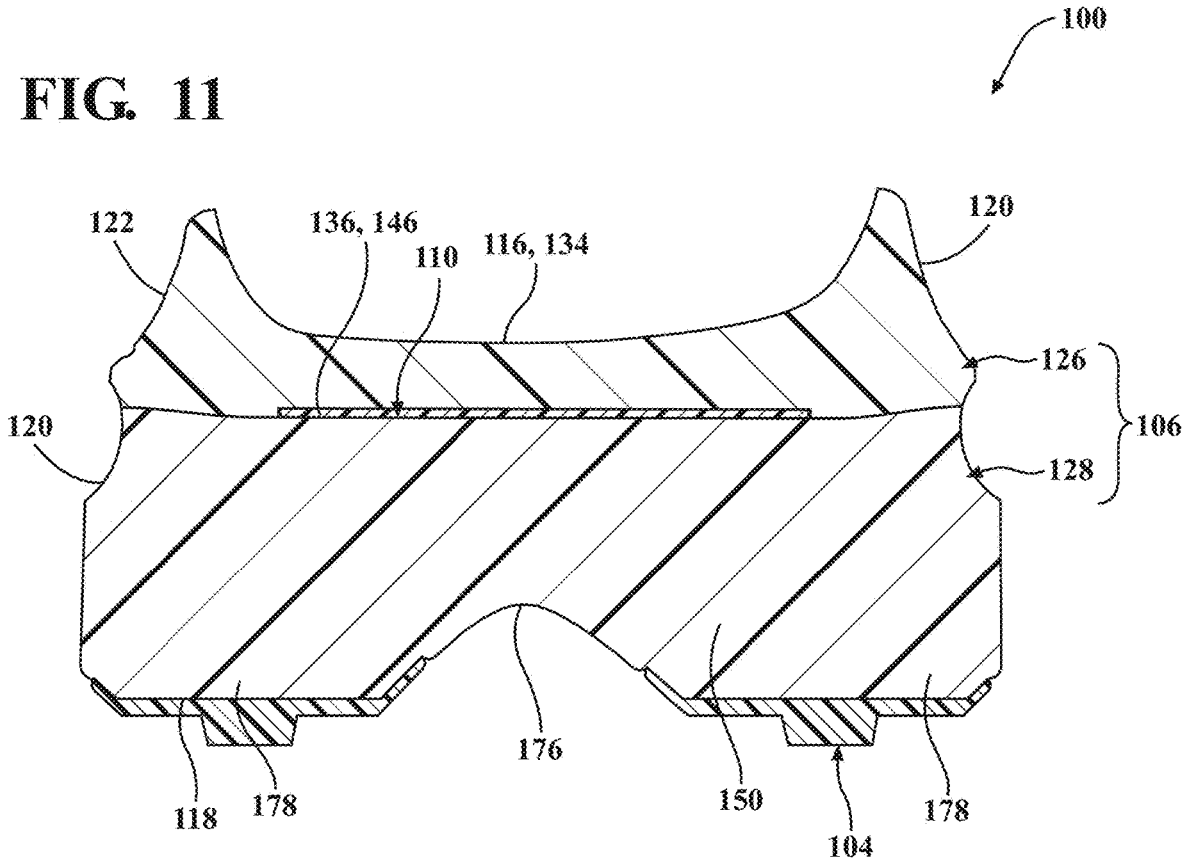
FIG. 11 is a cross-sectional view of the sole structure of FIG. 1, taken along Line 11-11 in FIG. 7.
Figure 12:
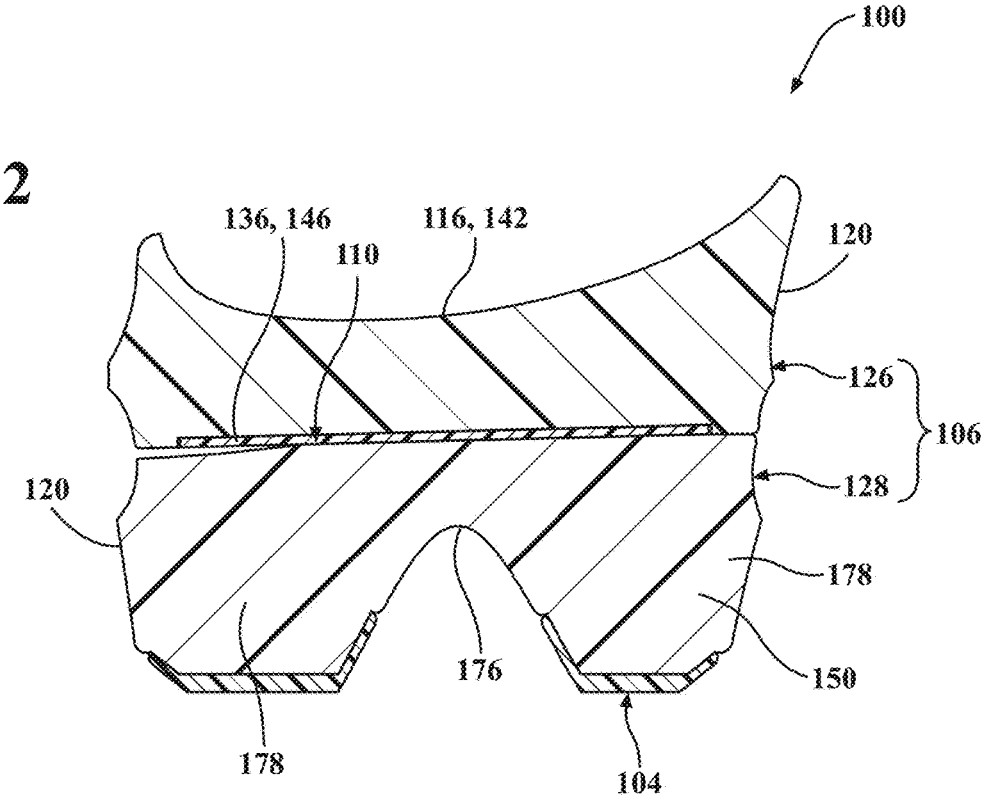
FIG. 12 is a cross-sectional view of the sole structure of FIG. 1, taken along Line 12-12 in FIG. 7.

In the illustrated example, the first end surface 160 is disposed between the toe portion $\mathbf{20}_T$ and the ball portion $\mathbf{20}_B$ and the second end surface 162 is disposed between the ball portion $\mathbf{20}_B$ and the mid-foot region 22. As best shown in FIG. 8, a distance from the first end surface 160 to the second end surface 162 defines a length $L_{130}$ of the receptacle 130, which tapers along a direction from the upper side 144 to the recessed support surface 164. In other words, the length $L_{130}$ of the receptacle 130 is greater at the upper side 144 than at the recessed support surface 164 to provide the receptacle with a generally trapezoidal cross-sectional profile.

The tapered length $L_{130}$ of the receptacle 130 is defined by forming each of the first end surface 160 and the second end surface 162 at an oblique angle $\theta_{160}$, $\theta_{162}$ angle relative to a central axis $A_{108}$ of the bladder 108. In other words, the first end surface 160 and the second end surface 162 may be described as extending at obtuse angles relative to the recessed support surface 164. For example, the first end surface 160 extends at a first oblique angle $\theta_{160}$ in a direction towards the first end 112 from the recessed support surface 164 to the upper side 144 and the second end surface 162 extends at a second oblique angle $\theta_{162}$ in a direction towards the second end 114 from the recessed support surface 164 to the upper side 144. Optionally, one or both of the first end surface 160 and the second end surface 162 may include a concave profile along the direction from the recessed support surface 164 to the upper side 144. For example, the first end surface 160 is shown as including a continuous curvature from the recessed support surface 164 to the upper side 144. Conversely, the second end surface 162 includes a substantially straight or flat portion extending from the upper side 144 and a concave transition portion connecting the straight portion and the recessed support surface 164. In other examples, either one or both of the end surfaces 160, 162 may be continuously curved or include a straight portion.

Referring to FIGS. 1 and 2, when the sole structure 100 is assembled, the length $L_{130}$ of the receptacle 130 is sufficient to provide gaps 166, 168 between the bladders 108 and the respective end surfaces 160, 162. The gaps 166, 168 include a first gap 166 disposed between the first end surface 160 and the bladders 108 and a second gap 168 disposed between the second end surface 162 and the bladders 108. The gaps 166, 168 provide an expansion space between the bladders 108 and the lower cushioning member 128. Thus, when the forefoot region 20 of the sole structure 100 is compressed, the bladders 108 and the lower cushioning member 128 may deform and extend into the gaps 166, 168 without contacting each other or the end surfaces 160, 162.

The recessed support surface 164 is spaced apart from the upper side 144 by a distance defining a height $H_{130}$ of the receptacle 130. As shown, the height $H_{130}$ of the receptacle 130 corresponds to a thickness $T_{108}$ of the bladders 108 such that the bladders 108 contact a bottom side of the plate 110 when the sole structure 100 is assembled. The tray 158 may further include one or more recessed sockets 170 formed in the recessed support surface 164. Each of the one or more sockets 170 is configured to receive a bottom side of a corresponding one of the bladders 108 within receptacle 130. Thus, the sockets 170 cooperate with the plate 110 and/or the upper cushioning member 126 to secure top and bottom sides of the bladders 108 within the receptacle 130. In the illustrated example, the tray 158 includes a pair of the sockets 170 such that the bladders 108 sit flush with the upper side 144 of the lower cushioning member 128 when the sole structure 100 is assembled. Here, a first one of the sockets 170 is disposed adjacent to the medial side 16 of the sole structure 100 in the ball portion $\mathbf{20}_B$ and a second one of the sockets 170 is disposed adjacent to the lateral side 18 of the sole structure 100 in the ball portion $\mathbf{20}_B$. As shown, the sockets 170 are exposed along the lateral and medial peripheral sides 120 and at the terminal, such that the bladders 108 are displayed and unconstricted along the sides 16, 18 when the sole structure 100 is assembled.

Optionally, the tray 158 may include a tongue 172 extending at least partially between the sockets 170. In the illustrated example, the tongue 172 extends from the second end surface 162 of the receptacle 130 to a terminal end 174 disposed between the sockets 170. The tongue 172 may have a tapered width along the direction from the second end surface 162 to the terminal end 174. The receptacle 130 may also include a recess or relief 175 formed in the first end surface 160, opposite the tongue 172. In the illustrated example, the relief 175 separates the posterior end of the anterior support segment 148 into medial and lateral segments that can articulate independently, thereby improving flexibility of the sole structure 100 across the forefoot region 20.

With continued reference to FIGS. 3-9, the posterior support segment 150 of the lower cushioning member 128 extends through the heel region 24 from the second end 114 of the cushioning element 106 to the second end surface 162 in the mid-foot region 22. The posterior support segment 150 may optionally include an elongate channel 176 formed in the bottom side 118 and extending from the mid-foot region 22 to the heel region 24. The channel 176 has a tapered or triangular cross section extending from an opening in the bottom side 118 to an apex between the bottom side 118 and the upper side 144. The channel 176 defines articulable medial and lateral lobes 178 extending along the length of the posterior support segment 150.

As described above, the components 126, 128 of the cushioning element 106 are formed of a resilient polymeric material, such as foam or rubber, to impart properties of cushioning, responsiveness, and energy distribution to the foot of the wearer. In the illustrated example, the upper cushioning member 126 includes a first foam material and the lower cushioning member 128 includes a second foam material. For example, the upper cushioning member 126 may include first foam materials providing greater cushioning and impact distribution, while the lower cushioning member 128 includes a foam material having a greater hardness or stiffness in order to provide increased stability to the bottom of the sole structure 100. Furthermore, and as discussed below, the tray 158 of the lower cushioning member 128 may have a greater hardness to maximize displacement of the bladder 108 when the forefoot region 20 is compressed.

Example resilient polymeric materials for the cushioning element 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, ethylene-vinyl alcohol (EVOH) copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acryl ate, polyethyl acryl ate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a BANBURY® mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 3 and 4, the plate 110 extends from a first end 180 in the toe portion $\mathbf{20}_T$ to a second end 182 in the heel region 24. The plate 110 includes a top side 184 and a bottom side 186 formed on an opposite side than the top side 184. A distance from the top side 184 to the bottom side 186 defines a thickness of the plate 110. An outer periphery extends between the top side 184 and the bottom side 186 and defines a peripheral profile of the plate 110, which corresponds to a peripheral profile of the upper and lower pockets 136, 146. The plate 110 may be embedded between the upper cushioning member 126 and/or the lower cushioning member 128 such that the top side 184 of the plate 110 is received in the upper plate pocket 136 and the bottom side 186 of the plate 110 is received in the lower pocket 146. Here, the first end 180 of the plate 110 is received within a portion of the lower pocket 146 defined by the anterior support segment 148 and the second end 182 of the plate 110 is received within a portion of the lower pocket 146 defined by the posterior support segment 150. Thus, the bottom side 186 of the plate 110 is exposed (i.e., visible) to the ground surface through the receptacle 130 between the anterior support segment 148 and the posterior support segment 150.

The plate 110 includes a material providing relatively high strength and stiffness, such as polymeric material and/or composite materials. In some examples, the plate 110 is a composite material manufactured using fiber sheets or textiles, including pre-impregnated (i.e., "prepreg") fiber sheets or textiles. Alternatively or additionally, the plate 110 may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other.

In some implementations, the plate 110 includes a substantially uniform thickness. In some examples, the thickness of the plate 110 ranges from about 0.6 millimeters (mm) to about 3.0 mm. In one example, the thickness of the plate 110 is substantially equal to one 1.0 mm. In other implementations, the thickness of the plate 110 is non-uniform such that the plate 110 may have a greater thickness in one region 20, 22, 24 of the sole structure 100 than the thicknesses in the other regions 20, 22, 24.

With particular reference to FIGS. 1-4 and 8, the one or more bladders 108 are shown to include a medial bladder 108 and a lateral bladder 108 received within the receptacle 130 of the cushioning element 106 between the upper cushioning member 126 and the lower cushioning member 128. More specifically, the bladders 108 are received within respective ones of the sockets 170. Thus, the medial bladder 108 is disposed in the first socket 170 proximate to the medial side 16 of the sole structure 100 while the lateral bladder 108 is disposed in the second socket 170 proximate to the lateral side 18 of the sole structure 100.

Each of the bladders 108 may include a pair of barrier layers 188*a*, 188*b* formed and joined together along a peripheral seam to define a chamber 190 within the bladder 108. Here, an upper barrier layer 188*a* defines a top side of the bladder 108 and a lower barrier layer 188*b* defines a bottom side of the bladder 108. When the sole structure 100 is assembled, the lower barrier layer 188*b* is received within one of the sockets 170 of the tray 158 such that the bladder 108 is supported on the foam material of the lower cushioning member 128. The top side of the upper barrier layer 188*a* is flush with the upper side 144 of the cushioning element 106 and attaches to the bottom side 186 of the plate 110 within the receptacle 130.

As used herein, the term "barrier layer" (e.g., barrier layers 188*a*, 188*b*) encompasses both monolayer and multilayer films. In some embodiments, one or both of the barrier layers 188*a*, 188*b* are each produced (e.g., thermoformed or blow molded) from a monolayer film (a single layer). In other embodiments, one or both of the barrier layers 188*a*, 188*b* are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 188*a*, 188*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 188*a*, 188*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including hexamethylene diisocyanate (HMDI), TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 188*a*, 188*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 188*a*, 188*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 188*a*, 188*b* may each independently include alternating sublayers of one or more TPU copolymer materials and one or more EVOH copolymer materials, where the total number of sublayers in each of the barrier layers 188*a*, 188*b* includes at least four (4) sublayers, at least ten (10) sublayers, at least twenty (20) sublayers, at least forty (40) sublayers, and/or at least sixty (60) sublayers.

The bladder 108 can be produced from the barrier layers 188*a*, 188*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 188*a*, 188*b* can be produced by co-extrusion followed by vacuum thermoforming to produce an inflatable chamber 190, which can optionally include one or more valves (e.g., one way valves) that allows the chamber 190 to be filled with the fluid (e.g., gas).

The chamber 190 can be provided in a fluid-filled (e.g., as provided in footwear 10) or in an unfilled state. The chamber 190 can be filled to include any suitable fluid, such as a gas or liquid. In an aspect, the gas can include air, nitrogen ($N_2$), or any other suitable gas. In other aspects, the chamber 190 can alternatively include other media, such as pellets, beads, ground recycled material, and the like (e.g., foamed beads and/or rubber beads). The fluid provided to the chamber 190 can result in the chamber 190 being pressurized. Alternatively, the fluid provided to the chamber 190 can be at atmospheric pressure such that the chamber 190 is not pressurized but, rather, simply contains a volume of fluid at atmospheric pressure.

The fluid-filled chamber 190 desirably has a low gas transmission rate to preserve its retained gas pressure. In some embodiments, the fluid-filled chamber 190 has a gas transmission rate for nitrogen gas that is at least about ten (10) times lower than a nitrogen gas transmission rate for a butyl rubber layer of substantially the same dimensions. In an aspect, fluid-filled chamber 190 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 188*a*, 188*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

The chamber 190 of each of the bladders 108 may receive a tensile element 192 (FIG. 8) therein. Each tensile element 192 may include a series of tensile strands 194 extending between an upper tensile sheet 196 and a lower tensile sheet 196. The upper tensile sheet 196 may be attached to a first one of the barrier layers 188*a* while the lower tensile sheet 196 may be attached to a second one of the barrier layers 188*b*. In this manner, when the chamber 190 receives the pressurized fluid, the tensile strands 194 of the tensile element 192 are placed in tension. Because the upper tensile sheet 196 is attached to the upper barrier layer 188*a* and the lower tensile sheet 196 is attached to the lower barrier layer 188*b*, the tensile strands 194 retain a desired shape of the bladders 108 when the pressurized fluid is injected into the chamber 190.

The upper 200 forms an enclosure having plurality of components that cooperate to define an interior void 202 and an ankle opening 204, which cooperate to receive and secure a foot for support on the sole structure 100. The upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

Figure 13:
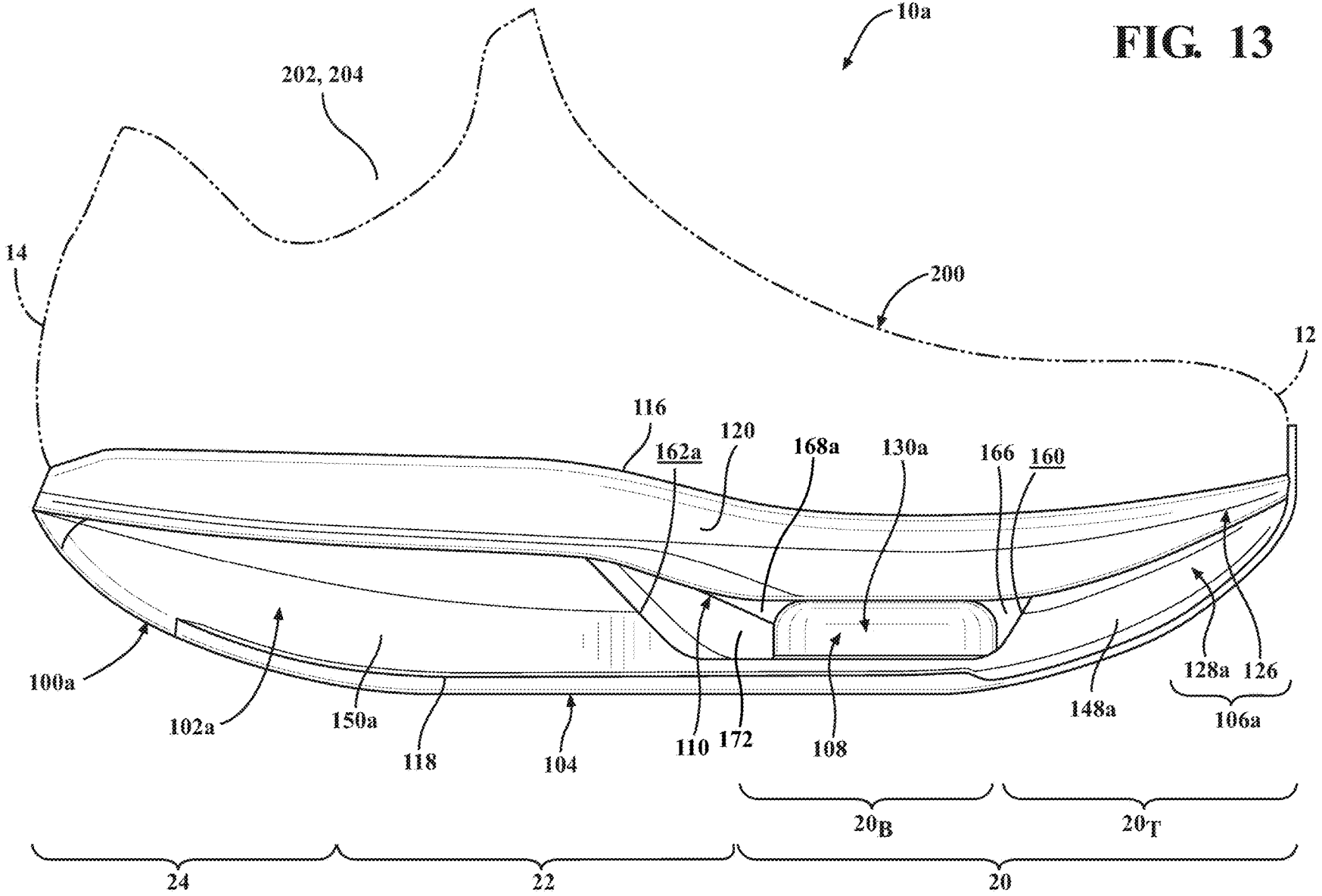
FIG. 13 is a lateral side view of a sole structure for an article of footwear according to an example of the present disclosure.
Figure 14:
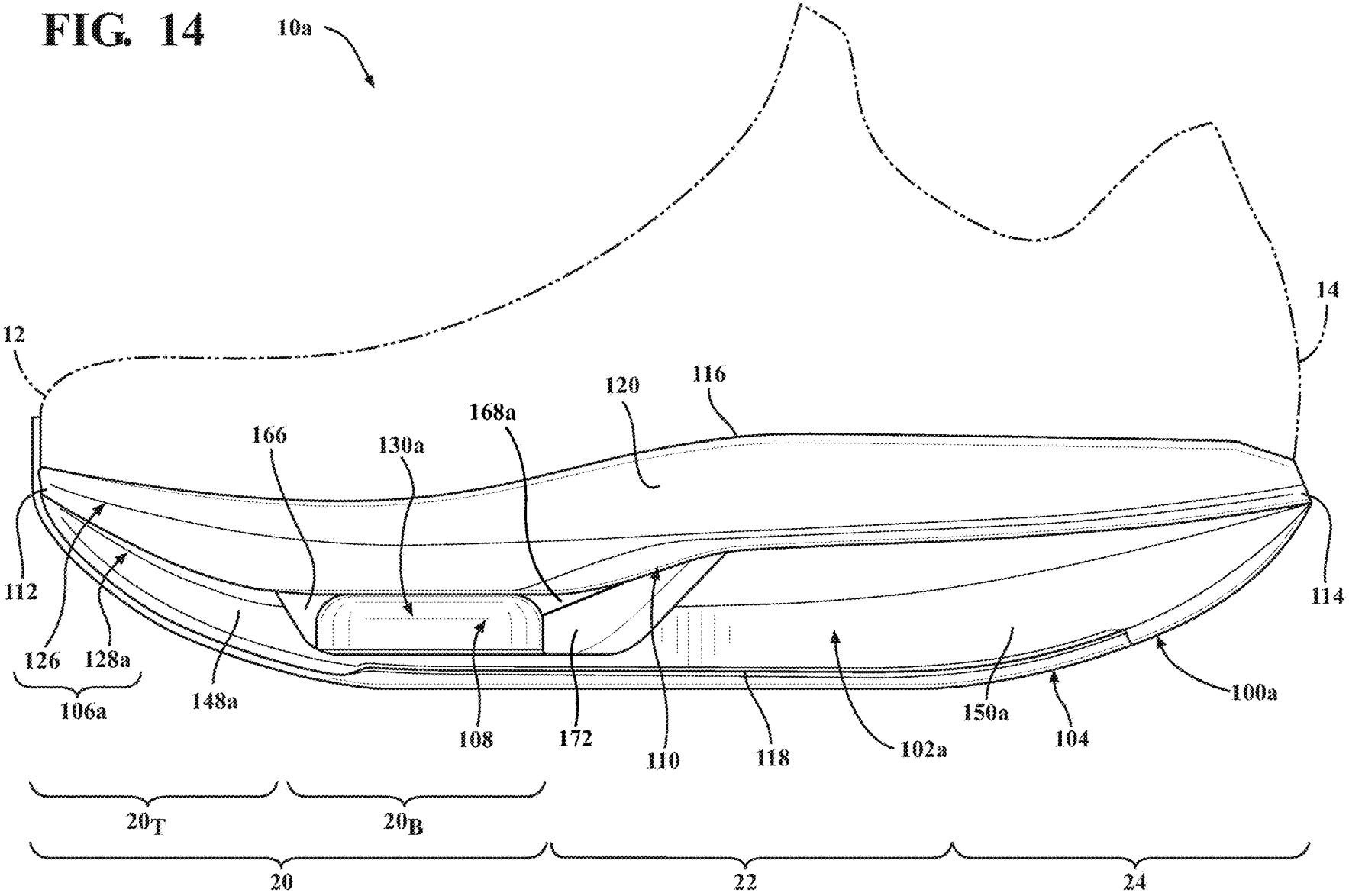
FIG. 14 is a medial side view of the sole structure of FIG. 13.

With particular reference to FIGS. 13 and 14, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The example of the sole structure 100*a* provided in FIGS. 13 and 14 includes a midsole 102*a* having a cushioning element 106*a* where a lower cushioning member 128*a* has a receptacle 130*a* with a greater length $L_{130a}$ than the receptacle 130 of the sole structure 100. Here, the receptacle 130*a* is defined between the first end surface 160 and a second end surface 162*a* that is positioned closer to the posterior end 14 than the second end surface 162 of the sole structure 100 described in FIGS. 1-12. As shown, the end surface 162*a* may be described as being positioned in an intermediate portion of the mid-foot region 22, whereas the end surface 162 of the sole structure 100 is positioned at the forefoot region 20.

With continued reference to FIGS. 13 and 14, the extended receptacle 130*a* of the lower cushioning member 128*a* defines a tray 158*a* that extends beyond a posterior end of the bladders 108 and into the mid-foot region 22 of the sole structure 100*a*. In contrast to the tray 158 of the sole structure 100, which terminates at the posterior end of the bladders 108 in the ball portion $20_B$ of the forefoot region 20, the tray 158*a* extends into the mid-foot region 22 and provides a cantilevered structure at the posterior end of the bladders 108. Optionally, the tray 158*a* of the sole structure 100*a* may include the tongue 172 from the second end surface 162*a* to the terminal end 174 disposed between the sockets 170 of the tray 158*a*.

The extended receptacle 130*a* and tray 158*a* result in the second gap 168*a* having an increased length (i.e., distance along the longitudinal axis $A_{10}$) from the posterior end of the bladders 108 to the second end surface 162*a*, which allows for additional flexibility between the forefoot region 20 and the mid-foot region 22 of the sole structure 100*a*.

With particular reference to FIGS. 15-27, an article of footwear 10*b* is provided and includes a sole structure 100*b* and the upper 200 attached to the sole structure 100*b*. In view of the substantial similarity in structure and function of the components associated with the article of footwear 10*a* with respect to the article of footwear 10*b*, like reference numerals are used hereinafter and in the drawings to identify like components while like reference numerals containing letter extensions are used to identify those components that have been modified.

Referring to FIGS. 15-27, the article of footwear 10*b* includes the sole structure 100*b* and the upper 200 attached to the sole structure 100*b*. The sole structure 100*b* includes a midsole 102*b* configured to provide cushioning and support and an outsole 104*b* defining a ground-engaging surface (i.e., contacts the ground during a stance phase of a gait cycle) of the sole structure 100*b*. Unlike conventional sole structures, which include monolithic midsoles and outsoles, the sole structure 100*b* of the present disclosure is configured as a composite structure including a plurality of components joined together. For example, the midsole 102*b* includes a resilient cushion or cushioning element 106*b*, one or more bladders 108, and a plate 110*b*. The outsole 104*b* is attached to the midsole 102*b* to provide traction and abrasion resistance.

Figure 15:
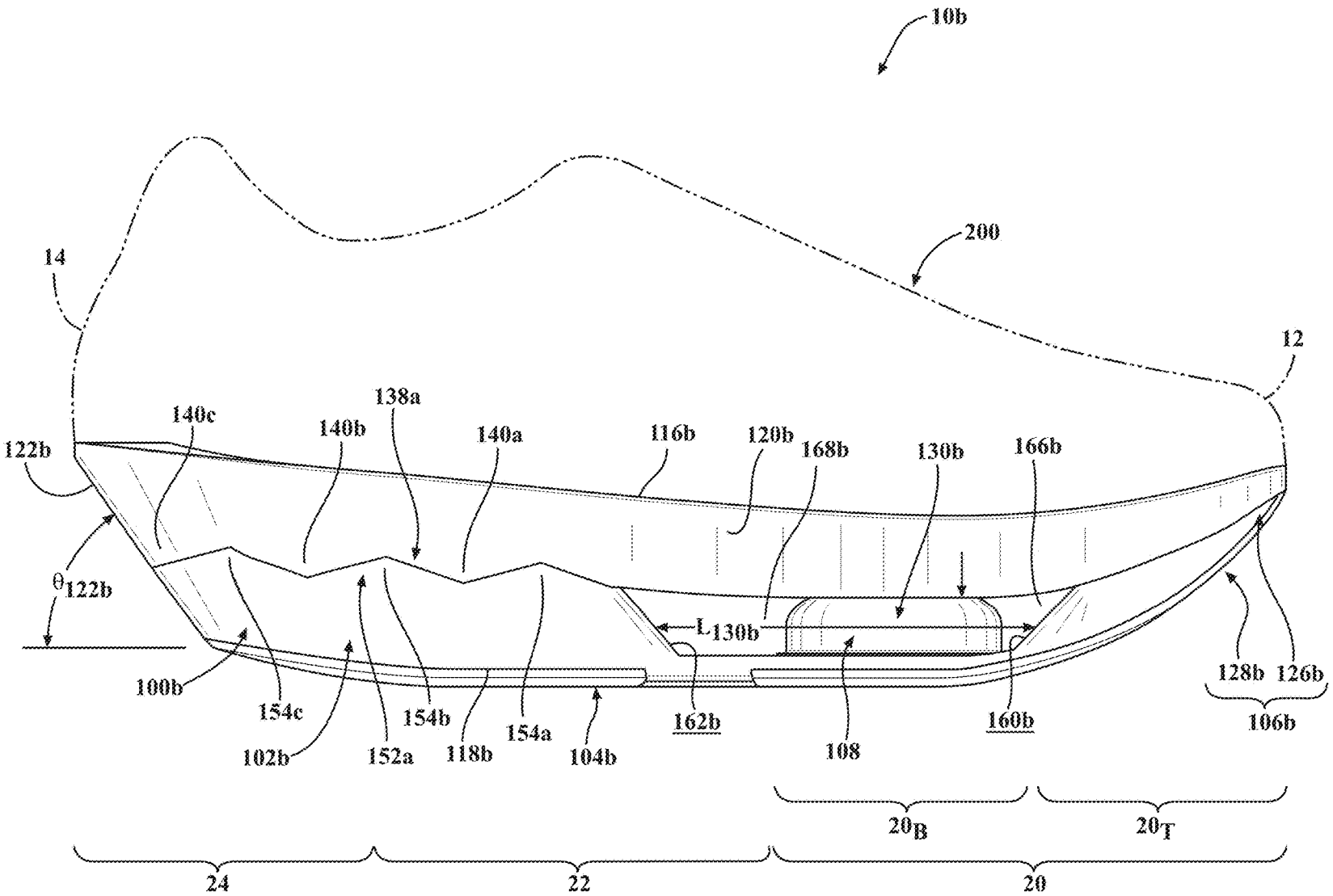
FIG. 15 is a lateral side view of a sole structure for an article of footwear according to an example of the present disclosure.
Figure 16:
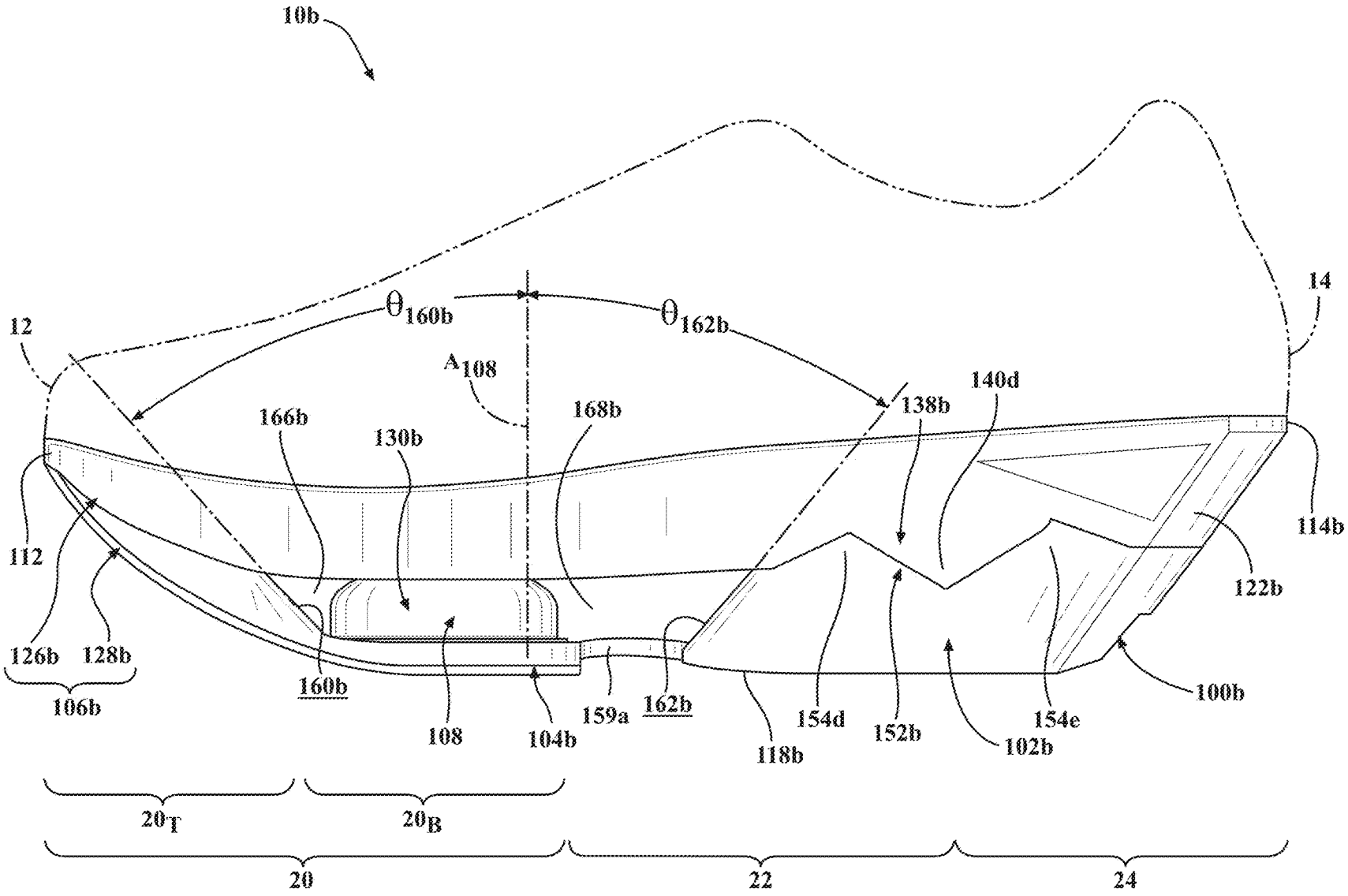
FIG. 16 is a medial side view of the sole structure of FIG. 15.

With reference to FIGS. 15 and 16, the cushioning element 106*b* of the midsole 102*b* extends from a first end 112*b* at the anterior end 12 of the footwear 10*b* to a second end 114*b* at the posterior end 14 of the footwear 10*b*. The cushioning element 106*b* further includes a top side 116*b* facing the upper 200 and defining a profile of a footbed of the sole structure 100*b*, a bottom side 118*b* formed on an opposite side of the cushioning element 106*b* from the top side 116*b* and defining a profile of the ground-contacting surface of the sole structure 100*b*, and a peripheral side 120*b* extending from the top side 116*b* to the bottom side 118*b* and defining an outer peripheral profile of the sole structure 100*b*.

Figure 25:
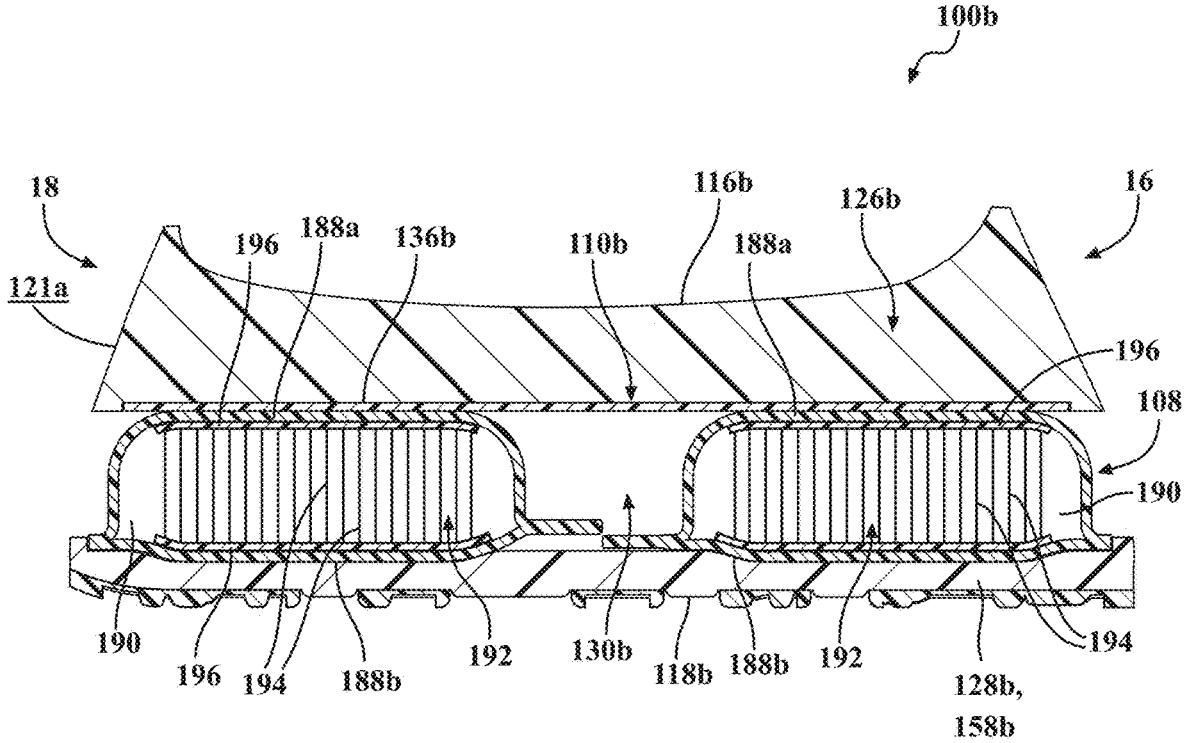
FIG. 25 is a cross-sectional view of the sole structure of FIG. 15, taken along Line 25-25 in FIG. 22.
Figure 26:
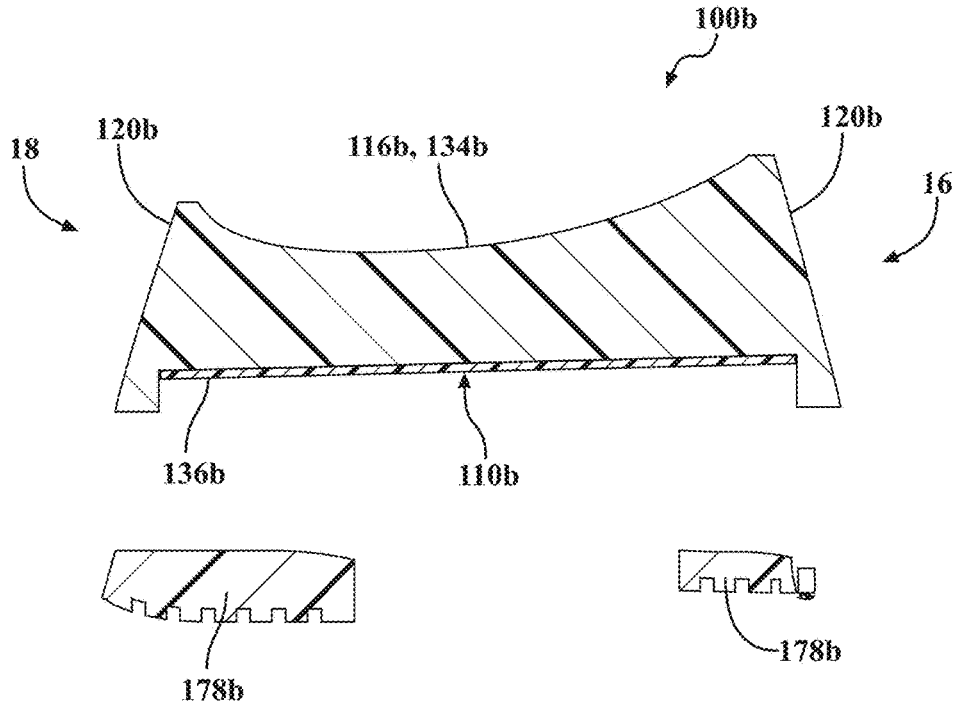
FIG. 26 is a cross-sectional view of the sole structure of FIG. 15, taken along Line 26-26 in FIG. 22.
Figure 27:
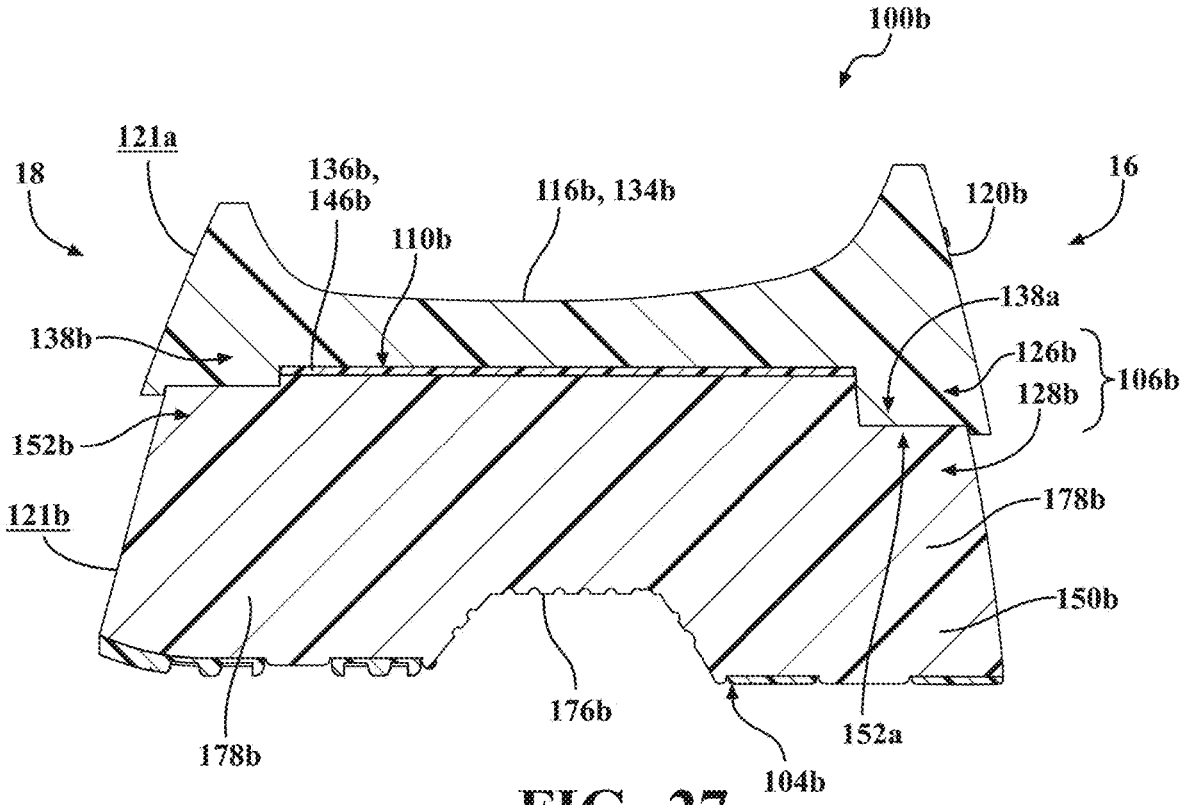
FIG. 27 is a cross-sectional view of the sole structure of FIG. 15, taken along Line 27-27 in FIG. 22.

As best shown in FIGS. 25-27, the peripheral side 120*b* of the cushioning element 106*b* may define an upper peripheral surface 121*a* and a lower peripheral surface 121*b* each extending along the medial side 16, the lateral side 18, and the posterior end 14 of the cushioning element 106*b*. Each of the upper peripheral surface 121*a* and the lower peripheral surface 121*b* have substantially straight cross-sectional profiles along a vertical axis of the sole structure (i.e., from the top side 116*b* of the cushioning element 106*b* to the bottom side 118*b* of the cushioning element 106*b*).

Along each of the medial side 16 and the lateral side 18 of the cushioning element 106*b*, the upper peripheral surface 121*a* and the lower peripheral surface 121*b* are oriented transverse to each other. Here, the lower peripheral surface 121*b* is angled outwardly relative to a vertical axis of the sole structure 100*b* such that a width $W_{106b}$ of the cushioning element increases or flares along the direction from the bottom side 118*b* to the top side 116*b*. Conversely, the upper peripheral surface 121*a* is angled inwardly relative to the vertical axis such that the width $W_{106b}$ of the cushioning element 106*b* decreases or tapers along the direction from the bottom side 118*b* to the top side 116*b*. Thus, the upper peripheral surface 121*a* and the lower peripheral surface 121*b* cooperate to provide increased stability while minimizing the overall profile of the sole structure 100*b* adjacent to the upper 200.

At the posterior end 14, the upper peripheral surface 121*a* and the lower peripheral surface 121*b* cooperate to define a substantially straight posterior wall 122*b*. In the illustrated example, the posterior wall 122*b* is substantially flat or planar along each of the lateral direction (e.g., from the medial side 16 to the lateral side 18) and the vertical direction (e.g., from the top side 116*b* to the bottom side 118*b*). Accordingly, the posterior wall 122*b* provides the posterior end 14 of the sole structure 100*b* with a blunted profile that intersects the aforementioned medial and lateral portions of the peripheral side 120*b* at respective edges or vertices that extend from the top side 116*b* to the bottom side 118*b*.

Figure 21:
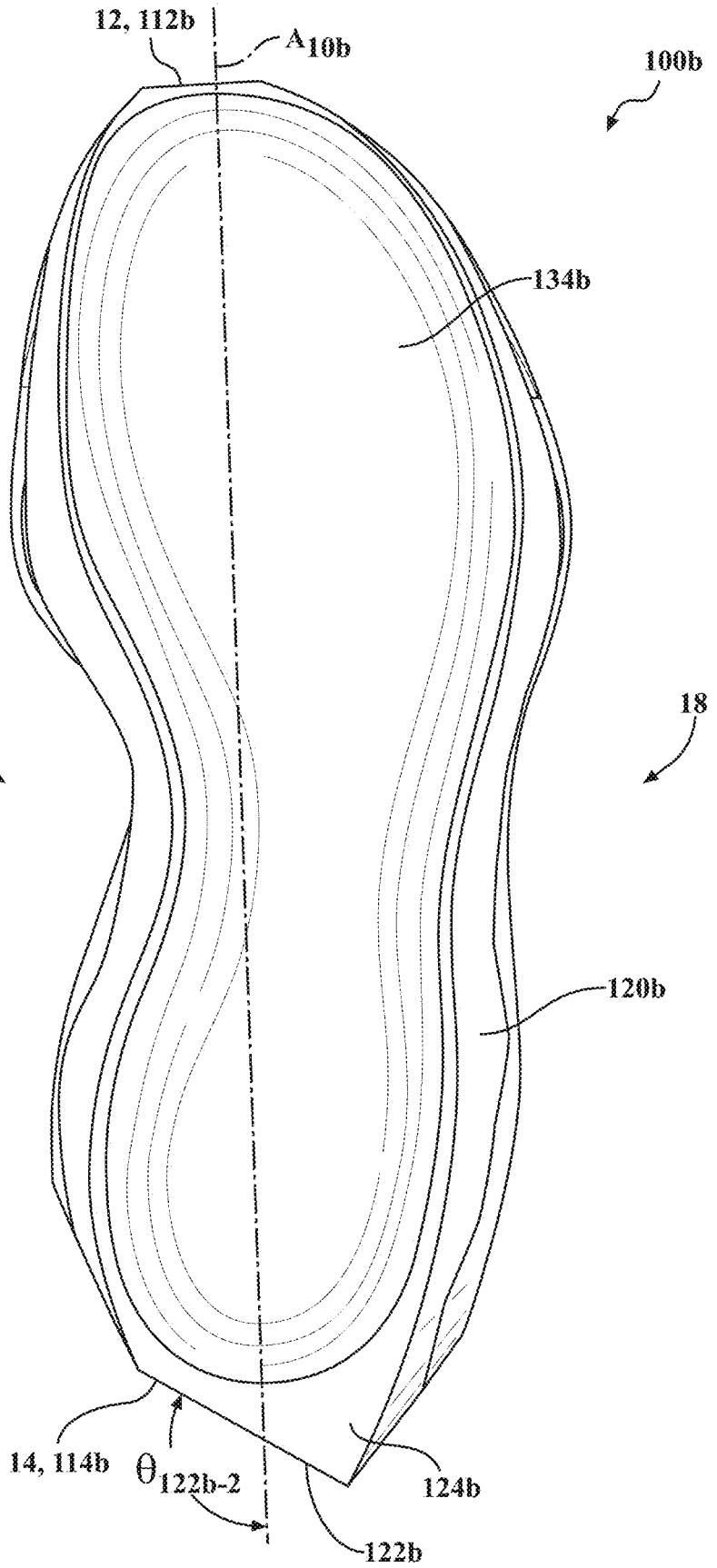
FIG. 21 is a top plan view of the sole structure of FIG. 15.
Figure 22:
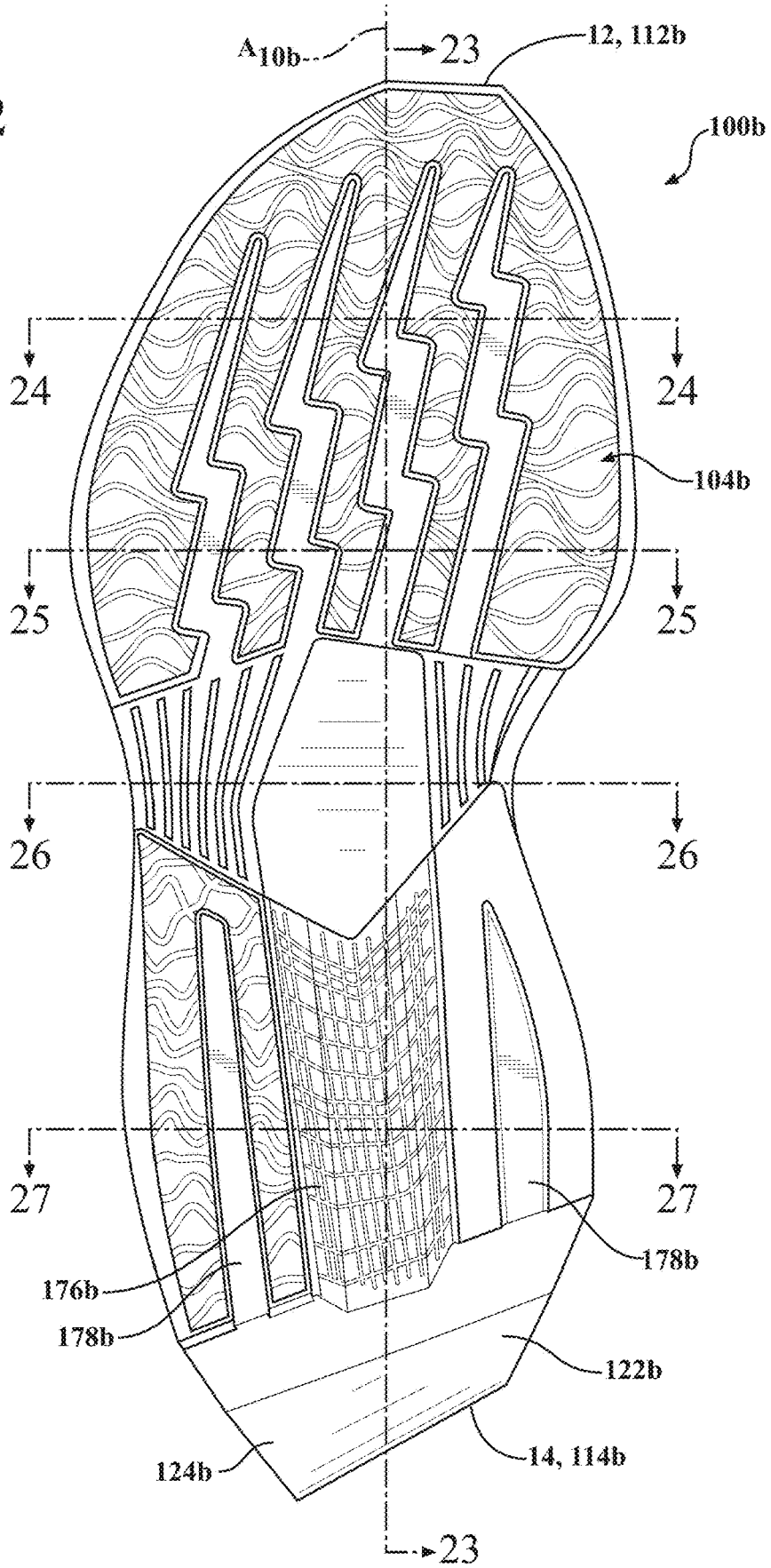
FIG. 22 is a bottom plan view of the sole structure of FIG. 15.
Figure 23:
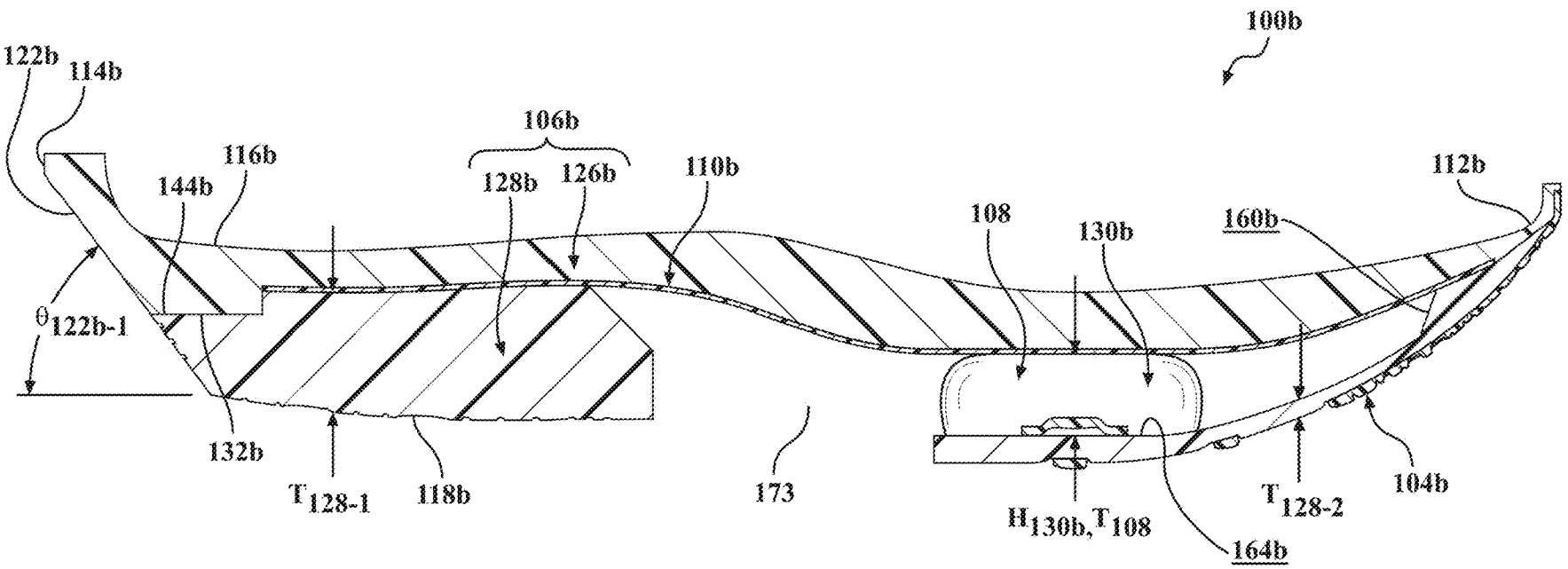
FIG. 23 is a cross-sectional view of the sole structure of FIG. 15, taken along Line 23-23 in FIG. 22.
Figure 24:
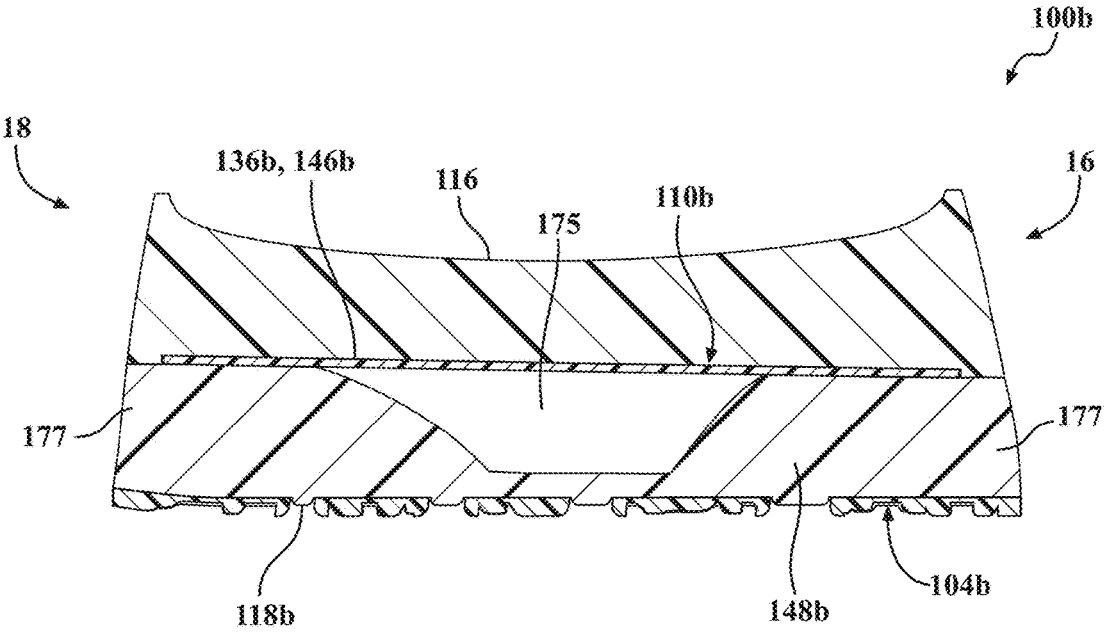
FIG. 24 is a cross-sectional view of the sole structure of FIG. 15, taken along Line 24-24 in FIG. 22.

With particular reference to FIG. 23, the posterior wall 122*b* may be oriented at a first oblique angle $\theta_{122b\text{-}1}$ relative to the longitudinal axis $A_{10b}$ of the footwear 10*b* along the direction from the bottom side 118*b* to the top side 116*b*. In other words, the posterior wall 122*b* extends away from the anterior end 12 along the direction from the bottom side 118*b* to the top side 116*b*. Additionally, as best shown in FIGS. 21 and 22, the posterior wall 122*b* is also oriented at a second oblique angle $\theta_{122b\text{-}2}$ relative to the longitudinal axis $A_{10b}$ along the direction from the medial side 16 to the lateral side 18. Here, the first oblique angle $\theta_{122b\text{-}1}$ and the second oblique angle $\theta_{122b\text{-}2}$ cooperate to provide the posterior wall 122*b* with a compound angle relative to the longitudinal axis $A_{10b}$. As shown in FIGS. 21 and 22, this compound angle results in a tapered stabilizer 124*b* formed at the posterior end 14 adjacent to the lateral side 18 of the sole structure 100*b*, which provides increased longitudinal support along the heel during the heel strike phase of a gait cycle while minimizing weight of the sole structure 100*b*.

While the cushioning element 106*b* may be formed as a monolithic structure including a homogenous elastomeric material, the cushioning element 106*b* of the present example is defined in terms of a plurality of portions or subcomponents. For example, the cushioning element 106*b* includes an upper cushion or cushioning member 126*b* disposed adjacent to the upper 200 and a lower cushion or cushioning member 128*b* disposed adjacent to the outsole 104*b*. Each of the upper cushioning member 126*b* and the lower cushioning member 128*b* extends continuously from the first end 112*b* of the cushioning element 106*b* to the second end 114*b* of the cushioning element 106*b*. In the illustrated example, the upper cushioning member 126*b* defines the upper peripheral surface 121*a* and the lower cushioning member 128*b* defines the lower peripheral surface 121*b*.

As described in greater detail below, the cushioning element 106*b* includes a receptacle 130*b* formed within the cushioning element 106*b* between the top side 116*b* and the bottom side 118*b* in the forefoot region 20. The receptacle 130*b* is configured to receive and support the one or more bladders 108 within the cushioning element 106*b*. In other words, the cushioning element 106*b* extends above the bladders 108 (i.e., between the bladders 108 and the upper 200) and beneath the bladders 108 (i.e., between the bladders 108 and the outsole 104*b*).

Figure 17:
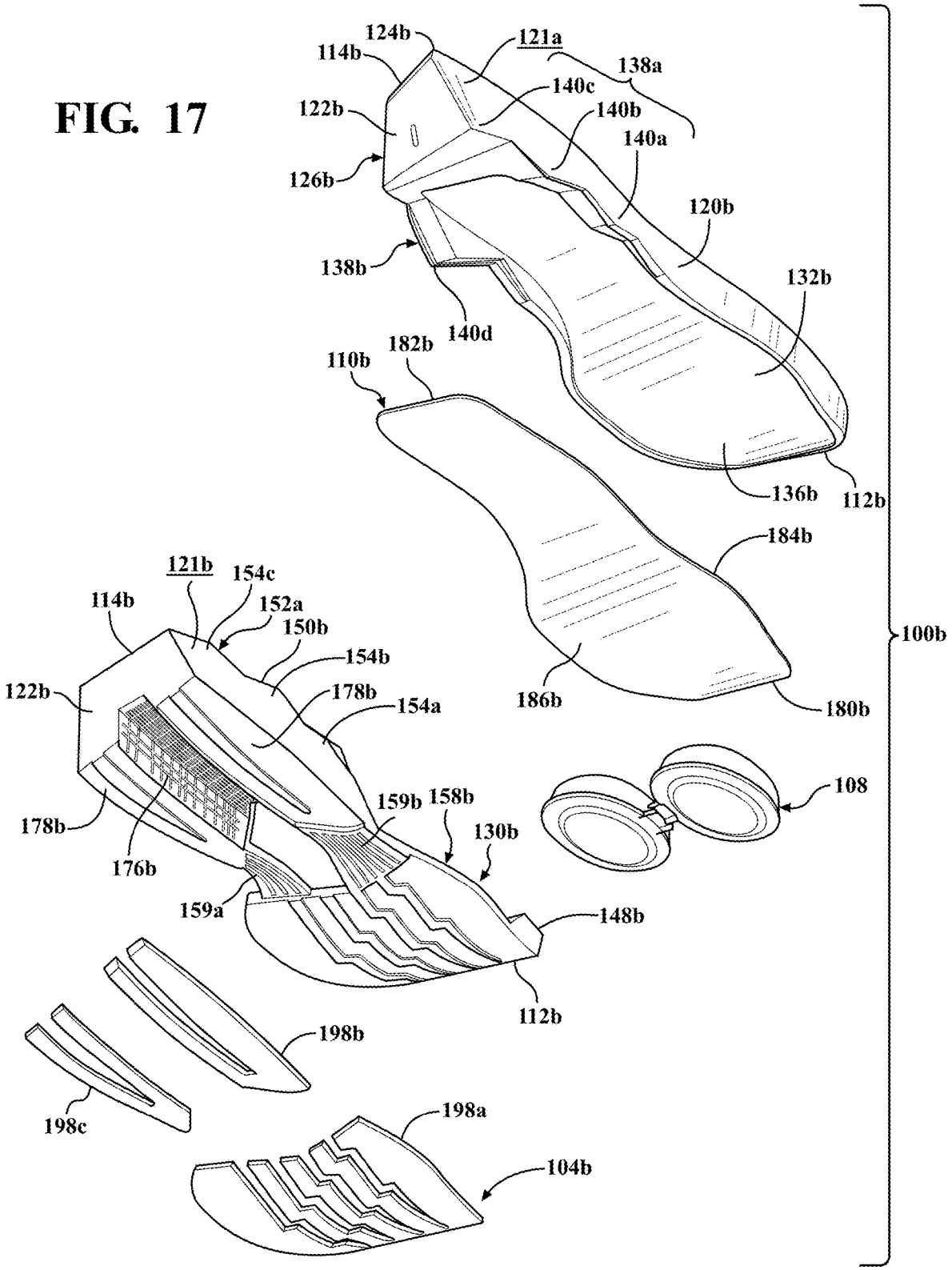
FIG. 17 is an exploded bottom perspective view of the sole structure of FIG. 15.
Figure 18:
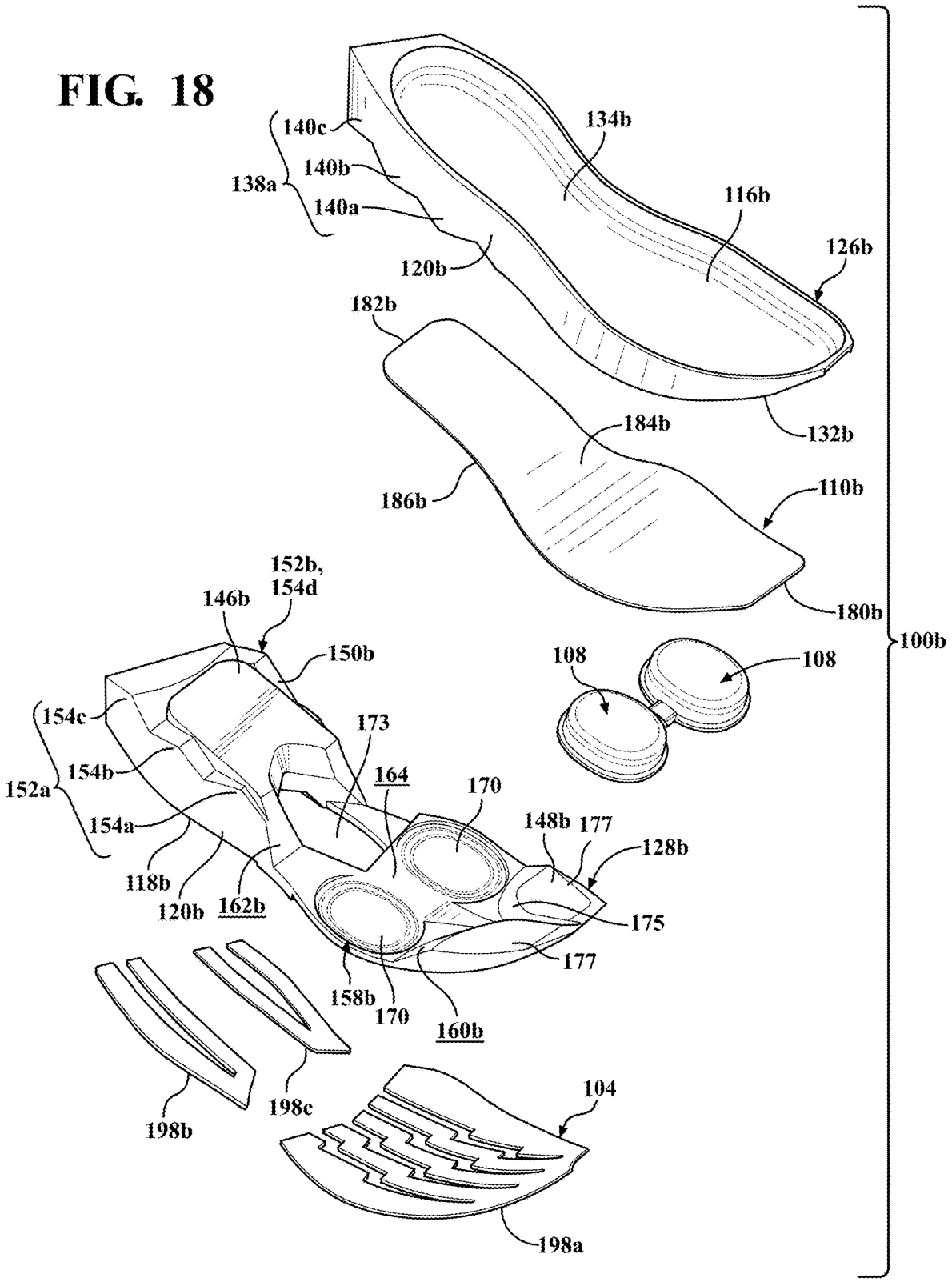
FIG. 18 is an exploded top perspective view of the sole structure of FIG. 15.
Figure 19:
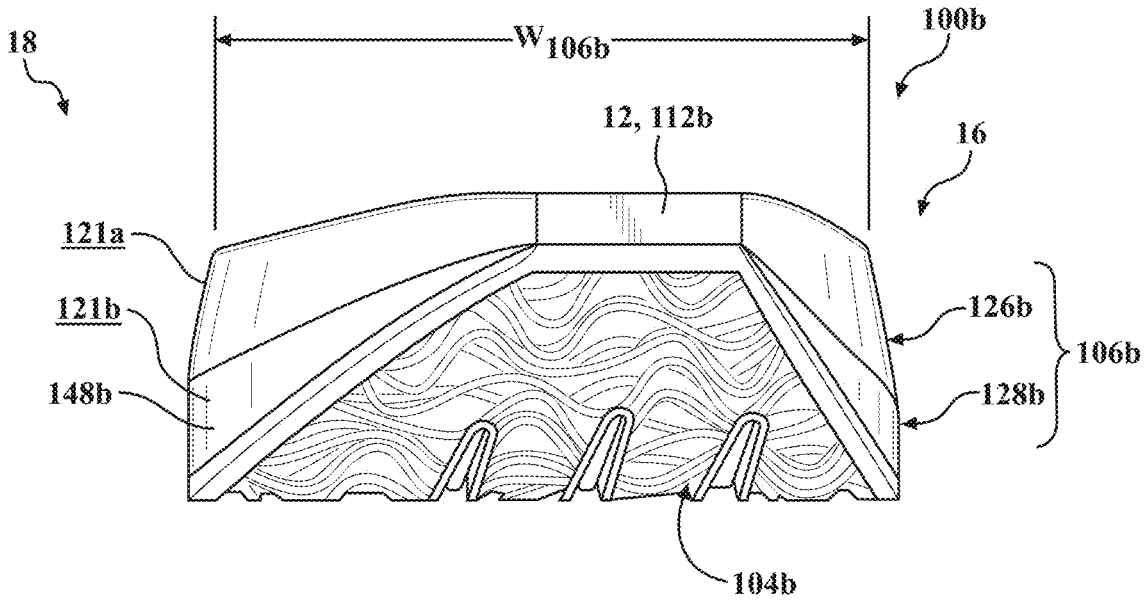
FIG. 19 is a front elevation view of the sole structure of FIG. 15.
Figure 20:
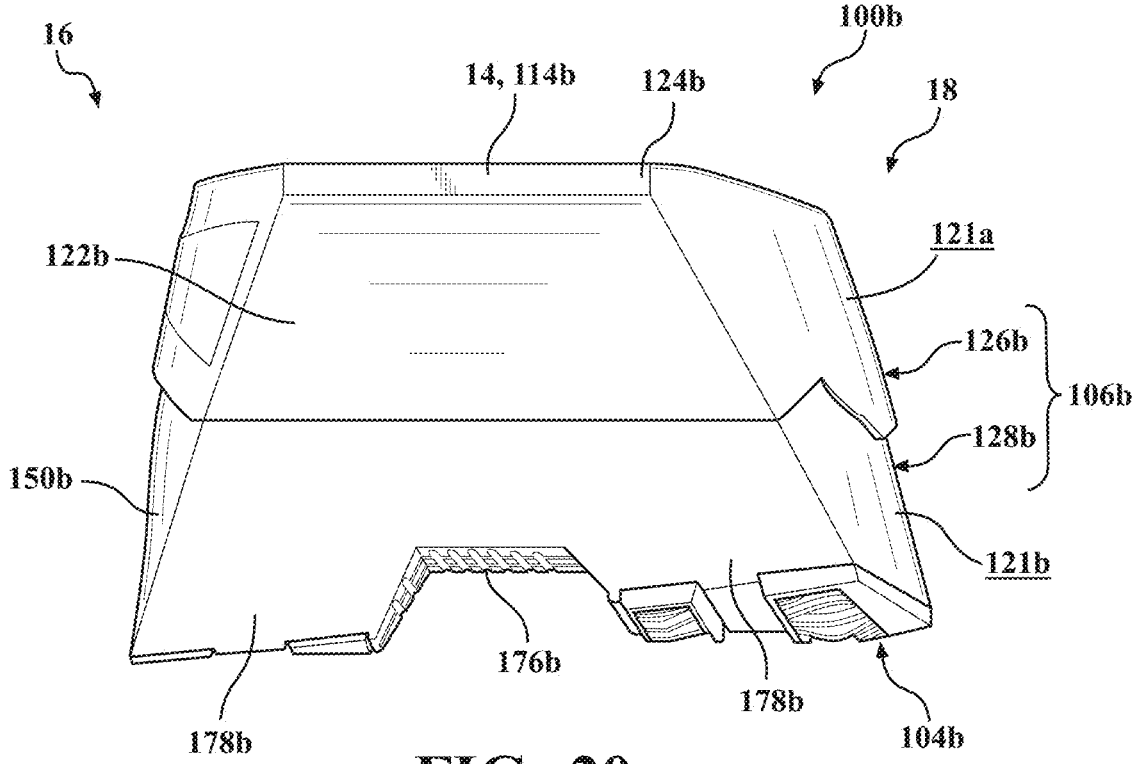
FIG. 20 is a rear elevation view of the sole structure of FIG. 15.

Referring now to FIGS. 17-23, the upper cushioning member 126*b* extends continuously from the first end 112*b* of the cushioning element 106*b* to the second end 114*b* of the cushioning element 106*b*. The upper cushioning member 126*b* includes the top side 116*b* of the cushioning element 106*b* and a lower side 132*b* formed on an opposite side of the upper cushioning member 126*b* than the top side 116*b*. The upper peripheral surface 121*a* of the peripheral side 120*b* connects the top side 116*b* to the lower side 132*b* and defines an outer peripheral profile of the upper cushioning member 126*b*. As shown in FIG. 18, the top side 116*b* of the upper cushioning member 126*b* defines the footbed 134*b* of the sole structure 100*b*. As shown in FIG. 17, the lower side 132*b* of the upper cushioning member 126*b* includes an upper plate pocket 136*b* configured to receive the plate 110*b* when the sole structure 100*b* is assembled.

The upper cushioning member 126*b* further includes one or more upper peripheral locking members 138*a*, 138*b* formed along the lower side 132*b* in the heel region 24. As best shown in FIGS. 17 and 18, the upper peripheral locking members 138*a*, 138*b* include a medial upper peripheral locking member 138*a* including one or more upper medial locking elements 140*a*-140*c* and a lateral upper peripheral locking member 138*b* including one or more upper lateral locking elements 140*d*. Here, the upper peripheral locking members 138*a*, 138*b* are formed adjacent to the peripheral side 120*b* along opposite sides of the upper plate pocket 136*b*. In other words, the upper plate pocket 136*b* separates the medial upper peripheral locking member 138*a* and the lateral upper peripheral locking member 138*b*. As discussed in greater detail below, the upper peripheral locking members 138*a*, 138*b* are configured to interface with corresponding lower peripheral locking members 152*a*, 152*b* of the lower cushioning member 128*b* to secure the upper cushioning member 126*b* to the lower cushioning member 128*b* in the heel region 24.

Referring still to FIGS. 17-23, the lower cushioning member 128*b* extends continuously from the first end 112*b* of the cushioning element 106*b* to the second end 114*b* of the cushioning element 106*b*. The lower cushioning member 128*b* may be described as including the bottom side 118*b* of the cushioning element 106*b* and an upper side 144*b* formed on an opposite side of the lower cushioning member 128*b* than the bottom side 118*b*. The lower peripheral surface 121*b* of the peripheral side 120*b* connects the bottom side 118*b* and the upper side 144 and defines an outer peripheral profile of the lower cushioning member 128*b*. When the sole structure 100*b* is assembled, the upper side 144*b* of the lower cushioning member 128*b* faces and is attached to the lower side 132*b* of the upper cushioning member 126*b* to form the cushioning element 106*b*.

As best shown in FIG. 18, the upper side 144*b* of the lower cushioning member 128*b* may optionally include a lower plate platform 146*b* configured to support the plate 110*b* in the heel region 24 when the sole structure 100*b* is assembled. Here, the lower plate platform 146*b* includes a substantially flat surface configured to support the plate 110*b* within the upper plate pocket 136*b* of the upper cushioning member 126*b*. Thus, when the sole structure 100*b* is assembled, the plate 110*b* is received within the upper plate pocket 136*b* formed in the lower side 132*b* of the upper cushioning member 126*b* and the lower plate platform 146*b* mates with the lower plate pocket 136*b* to secure the plate 110*b* within the upper plate pocket 136*b* in the heel region 24.

Although the lower cushioning member 128*b* is formed as a continuous structure extending from the first end 112*b* to the second end 114*b*, the lower cushioning member 128*b* may be described as including an anterior support segment 148*b* disposed adjacent to the first end 112*b*, a posterior support segment 150*b* disposed adjacent to the second end 114*b*, and a tray 158*b* connecting the anterior support segment 148*b* and the posterior support segment 150*b*. The anterior support segment 148*b* and the posterior support segment 150*b* each define a first thickness $T_{128\text{-}1}$ of the lower cushioning member 128*b* extending from the bottom side 118*b* to the upper side 144*b* and the tray 158*b* defines a second thickness $T_{128\text{-}2}$ that is less than the first thickness $T_{128\text{-}1}$ in the ball portion $\mathbf{20}_B$ of the lower cushioning member 128. Accordingly, the different thicknesses $T_{128\text{-}1}$, $T_{128\text{-}2}$ of the lower cushioning member 128*b* cooperate to define the receptacle 130*b* in the ball portion $\mathbf{20}_B$ of the lower cushioning member 128*b*.

The posterior support segment 150*b* of the lower cushioning member 128*b* further includes one or more lower peripheral locking members 152*a*, 152*b* formed along the upper side 144*b* in the heel region 24. As best shown in FIGS. 15-18, the lower peripheral locking members 152*a*, 152*b* include a medial lower peripheral locking member 152*a* including one or more lower medial locking elements 154*a*-154*c* and a lateral lower peripheral locking member 152*b* including one or more lower lateral locking elements 154*d*, 154*e*. Here, the lower peripheral locking members 152*a*, 152*b* are formed adjacent to the peripheral side 120*b* along opposite sides of the lower plate platform 146*b*. In other words, the lower plate platform 146*b* separates the medial lower peripheral locking member 152*a* and the lateral lower peripheral locking member 152*b*.

When the sole structure 100*b* is assembled, the upper peripheral locking members 138*a*, 138*b* of the upper cushioning member 126*b* interface with the lower peripheral locking members 152*a*, 152*b* of the lower cushioning member 128*b* in the heel region. Particularly, the upper peripheral locking members 138*a*, 138*b* are configured to mate with the lower peripheral locking members 152*a*, 152*b* along the medial and lateral sides of the cushioning element 106*b*. In the illustrated example, the upper locking elements 140*a*-140*d* and the lower locking elements 154*a*-154*e* are formed as teeth or peaks configured to mate with opposing valleys when the cushioning element 106*b* is assembled. However, other geometries of mating locking elements may be utilized, such as undulated or arcuate peaks, or rectangular teeth. By providing the upper locking elements 140*a*-140*d* and the lower locking elements 154*a*-154*d*, the mating surface area between the upper cushioning member 126*b* and the lower cushioning member 128*b* is maximized relative to an interface having a substantially flat joint. Furthermore, the angular profile provides a structural interface between the upper cushioning member 126*b* and the lower cushioning member 128*b* to maximize stability in the heel region 24. Thus, when the opposing sides 132*b*, 144*b* of the cushioning members 126*b*, 128*b* are joined together, such as by an adhesive or melding process, the peripheral locking members 138*a*, 138*b*, 152*a*, 152*b* improve stability between the cushioning members 126*b*, 128*b*.

As shown, the receptacle 130*b* of the sole structure 100*b* extends along the direction of the longitudinal axis $A_{10b}$ from a first end surface 160*b* to a second end surface 162*b* that faces the first end surface 160*b*. Thus, the first end surface 160*b* defines a posterior end of the anterior support segment 148*b* and the second end surface 162*b* defines an anterior end of the posterior support segment 150*b*. The receptacle 130*b* is further defined by a recessed support surface 164*b* connecting the first end surface 160*b* and the second end surface 162*b*. In the illustrated example, each of the surfaces 160*b*, 162*b*, 164*b* extends continuously across an entire width of the midsole 102*b* from the medial side 16 to the lateral side 18 such that the receptacle 130*b* effectively forms a channel extending across the width of the sole structure 100*b*.

In the illustrated example, the first end surface 160*b* is disposed between the toe portion $\mathbf{20}_T$ and the ball portion $\mathbf{20}_B$ and the second end surface 162*b* is disposed in the mid-foot region 22. As best shown in FIGS. 15 and 16, a distance from the first end surface 160*b* to the second end surface 162*b* defines a length $L_{130b}$ of the receptacle 130*b*, which tapers along a direction from the upper side 144*b* to the recessed support surface 164*b*. In other words, the length $L_{130b}$ of the receptacle 130*b* is greater at the upper side 144*b* than at the recessed support surface 164*b* to provide the receptacle with a generally trapezoidal cross-sectional profile.

The tapered length $L_{130b}$ of the receptacle 130*b* is defined by forming each of the first end surface 160*b* and the second end surface 162*b* at an oblique angle $\theta_{160b}$, $\theta_{162b}$ relative to a central axis $A_{108}$ of the bladder 108. In other words, the first end surface 160*b* and the second end surface 162*b* may be described as extending at obtuse angles relative to the recessed support surface 164*b*. For example, the first end surface 160*b* extends at a first oblique angle $\theta_{160b}$ in a direction towards the first end 112*b* from the recessed support surface 164*b* to the upper side 144*b* and the second end surface 162*b* extends at a second oblique angle $\theta_{16b2}$ in a direction towards the second end 114*b* from the recessed support surface 164*b* to the upper side 144*b*.

Referring to FIGS. 15 and 16, when the sole structure 100*b* is assembled, the length $L_{130b}$ of the receptacle 130*b* is sufficient to provide gaps 166*b*, 168*b* between the bladders 108 and the respective end surfaces 160*b*, 162*b*. The gaps 166*b*, 168*b* include a first gap 166*b* disposed between the first end surface 160*b* and the bladders 108 and a second gap 168*b* disposed between the second end surface 162*b* and the bladders 108. The gaps 166*b*, 168*b* provide an expansion space between the bladders 108 and the lower cushioning member 128*b*. Thus, when the forefoot region 20 of the sole structure 100*b* is compressed, the bladders 108 and the lower cushioning member 128*b* may deform and extend into the gaps 166*b*, 168*b* without contacting each other or the end surfaces 160*b*, 162*b*.

The recessed support surface 164*b* is spaced apart from the upper side 144*b* by a distance defining a height $H_{130b}$ of the receptacle 130*b*. As shown, the height $H_{130b}$ of the receptacle 130*b* corresponds to a thickness $T_{108}$ of the bladders 108 such that the bladders 108 contact a bottom side of the plate 110*b* when the sole structure 100*b* is assembled. The tray 158*b* may further include one or more recessed sockets 170 formed in the recessed support surface 164*b*. Each of the one or more sockets 170 is configured to receive a bottom side of a corresponding one of the bladders 108 within receptacle 130*b*. Thus, the sockets 170 cooperate with the plate 110*b* and/or the upper cushioning member 126*b* to secure top and bottom sides of the bladders 108 within the receptacle 130*b*. In the illustrated example, the tray 158*b* includes a pair of the sockets 170 such that the bladders 108 sit flush with the upper side 144*b* of the lower cushioning member 128*b* when the sole structure 100*b* is assembled. Here, a first one of the sockets 170 is disposed adjacent to the medial side 16 of the sole structure 100*b* in the ball portion $\mathbf{20}_B$ and a second one of the sockets 170 is disposed adjacent to the lateral side 18 of the sole structure 100*b* in the ball portion $\mathbf{20}_B$. As shown, the sockets 170 are exposed along the lateral and medial peripheral sides 120*b* and at the terminal, such that the bladders 108 are displayed and unconstricted along the sides 16, 18 when the sole structure 100*b* is assembled.

The tray 158*b* may be connected by a pair of connectors 159*a*, 159*b* extending along opposite sides of the lower cushioning member 128*b* and separated by an opening 173. The connectors 159*a*, 159*b* include a medial connector 159*a* and a lateral connector 159*b*. The lateral connector 159*b* is formed substantially continuously (e.g., same thickness, flush transition) with the tray 158*b* along the lateral side 18 of the sole structure. However, the medial connector 159*a* may be formed as an optionally detachable component of the lower cushioning member 128*b*, whereby the medial connector 159*a* has a reduced thickness compared to the tray 158*b* to form a detachment joint between the medial connector 159*a* and the tray 158*b*. Thus, a user may remove the medial connector 159*a* to increase flexibility of the cushioning element 106*b* along the medial side 16 of the sole structure 100*b*.

Referring to FIGS. 18 and 22, the lower cushioning member 128*b* may optionally include the opening 173 extending through an entire thickness of the lower cushioning member 128*b* between the posterior support segment 150*b* and the tray 158*b*. As shown in FIG. 18, the opening 173 has a length that is greater than a length of the second gap 168*b* such that the opening 173 extends at least partially through the anterior end of the posterior support segment 150*b*. In other words, the opening 173 extends partially through the posterior support segment 150*b* and forms a recess or notch in the second end surface 162*b*, which may improve torsional movement of the posterior support segment 150*b* about the longitudinal axis.

The lower cushioning member 128*b* may further include a notch or groove 175 extending through the anterior support segment 148*b* along the direction of the longitudinal axis $A_{10b}$. As best shown in FIG. 18, the groove 175 extends from the first end 112*b* of the cushioning element 106*b* to the receptacle 130*b* and separates the anterior support segment 148*b* into a pair of anterior lobes 177, which provide increased lateral flexibility along the toe portion $\mathbf{20}_T$ of the cushioning element.

With continued reference to FIGS. 17-22 and 26, the posterior support segment 150*b* of the lower cushioning member 128*b* extends through the heel region 24 from the second end 114*b* of the cushioning element 106*b* to the second end surface 162*b* in the mid-foot region 22. The posterior support segment 150*b* may optionally include an elongate channel 176*b* formed in the bottom side 118*b* and extending from the mid-foot region 22 to the heel region 24. The channel 176*b* has a tapered or trapezoidal cross section extending from an opening in the bottom side 118*b* to an upper surface between the bottom side 118*b* and the upper side 144*b*. The channel 176*b* defines articulable medial and lateral lobes 178*b* extending along the length of the posterior support segment 150*b*.

As described above, the components 126*b*, 128*b* of the cushioning element 106*b* are formed of a resilient polymeric material, such as foam or rubber, to impart properties of cushioning, responsiveness, and energy distribution to the foot of the wearer. In the illustrated example, the upper cushioning member 126*b* includes a first foam material and the lower cushioning member 128*b* includes a second foam material. In the illustrated example, the first foam material and the second foam material include the same material such that the upper cushioning member 126*b* and the lower cushioning member 128*b* have similar physical properties.

With continued reference to FIGS. 17 and 18, the plate 110*b* extends from a first end 180*b* in the toe portion $\mathbf{20}_T$ to a second end 182*b* in the heel region 24. While the plate 110*b* may have a substantially similar construction and profile as the plate 110 described previously, the first end 180*b* and the second end 182*b* of the plate 110*b* are blunted or straight to minimize the weight of the plate while providing comparable performance. The plate 110*b* includes a top side 184*b* and a bottom side 186*b* formed on an opposite side than the top side 184*b*. A distance from the top side 184*b* to the bottom side 186*b* defines a thickness of the plate 110*b*. An outer periphery extends between the top side 184*b* and the bottom side 186*b* and defines a peripheral profile of the plate 110*b*, which corresponds to a peripheral profile of the upper plate pocket 136*b* and the lower support platform 146*b*. The plate 110*b* may be embedded between the upper cushioning member 126*b* and/or the lower cushioning member 128*b* such that the plate 110*b* is received in the upper plate pocket 136*b* and the bottom side 186*b* of the plate 110*b* is received on the upper side 144*b* and the lower plate platform 146*b*. Thus, the bottom side 186*b* of the plate 110*b* is exposed (i.e., visible) to the ground surface through the receptacle 130*b* between the anterior support segment 148*b* and the posterior support segment 150*b*.

With particular reference to FIGS. 15-18 and 25, the one or more bladders 108 are shown to include a medial bladder 108 and a lateral bladder 108 received within the receptacle 130*b* of the cushioning element 106*b* between the upper cushioning member 126*b* and the lower cushioning member 128*b*. More specifically, the bladders 108 are received within respective ones of the sockets 170. Thus, the medial bladder 108 is disposed in the first socket 170 proximate to the medial side 16 of the sole structure 100*b* while the lateral bladder 108 is disposed in the second socket 170 proximate to the lateral side 18 of the sole structure 100*b*.

Optionally, the outsole 104*b* may be formed as a fragmentary structure including a plurality of independent outsole segments 198*a*-198*c*. For example, the outsole segments include a forefoot outsole segment 198*a*, a medial heel outsole segment 198*b* attached to a first one of the heel lobes 178*b*, and a lateral heel outsole segment 198*c* attached to a second one of the heel lobes 178*c*.

In use, forming the lower cushioning member 128-128*b* as a continuous structure extending from the forefoot region 20 to the heel region 24 provides a synergistic compression of the bladders 108 as the sole structure flexes during the gait cycle. For example, by connecting the tray 158-158*b* to both the anterior support segment 148-148*b* and the posterior support segment 150-150*b*, the tray 158-158*b* is drawn into tension as the forefoot region 20 is stretched during the push-off phase of a gait cycle. As the tray 158-158*b* is drawn into tension, the tray 158-158*b* may impart a compressive force on the bladders 108, which provide a responsive biasing force to counter the compression. Furthermore, providing the gaps 166-166*b*, 168-168*b* adjacent to the ends of the bladders 108 allows the peripheral portions of the bladders 108 defined by the barrier layers 188*a*, 188*b* to expand into the gaps as the bladders 108 are compressed between the plate 110*b* and the tray 158*b*.

The articulation of the bladder 108 also supports a new underfoot sensation. By decreasing layers between foot and bladder 108 and placing the bladder 108 between two relatively hard surfaces (i.e., the plate 110*b* and the tray 158-158*b*), the article of footwear 10-10*b* maximizes the displacement of the bladder 108 to achieve a more pronounced bounce with each walking stride. Performance of the sole structure 100-100*b* may be tuned by adjusting the ratio of the size of the tensile element 192 to the size of the bladder 108, thereby modifying the amount of the barrier layers 188*a*, 188*b* that is constrained by the tensile element 192. For example, decreasing a width $W_{192}$ of the tensile element 192 relative to an overall width $W_{108}$ of the bladder 108 will result in a greater portion of the barrier layers 188*a*, 188*b* being unconstrained, thereby allowing the barrier layers 188*a*, 188*b* to expand to a greater extent when compressive forces are applied to the bladder 108 than a bladder of comparable size having a tensile element 192 with a greater width $W_{192}$.

The following Clauses provide example configurations for the sole structure and article of footwear described above.

Clause 1. A sole structure for an article of footwear, the sole structure comprising a first cushion extending continuously from an anterior end of the sole structure to a posterior end of the sole structure and including an upper side, a bottom side formed on an opposite side from the upper side, and a recess formed in the upper side, a first bladder disposed within the recess adjacent to a lateral side of the sole structure, and a second bladder disposed within the recess adjacent to a medial side of the sole structure.

Clause 2. The sole structure of Clause 1, wherein the recess extends across an entire width of the first cushion from the medial side to the lateral side.

Clause 3. The sole structure of any of the preceding Clauses, wherein the recess is disposed in a forefoot region of the first cushion.

Clause 4. The sole structure of any of the preceding Clauses, wherein the recess extends from a first end surface adjacent to a toe portion of the sole structure to a second end surface disposed in one of a forefoot region or a mid-foot region of the sole structure.

Clause 5. The sole structure of Clause 4, wherein at least one of the first end surface or the second end surface is spaced apart from each of the first bladder and the second bladder.

Clause 6. The sole structure of Clause 4, wherein at least one of the first end surface and the second end surface is oriented at an oblique angle relative to a central axis of the first bladder.

Clause 7. The sole structure of Clause 6, wherein the first end surface is oriented at a first oblique angle relative to the central axis of the first bladder and the second end surface is oriented at a second oblique angle relative to the central axis.

Clause 8. The sole structure of any of the preceding Clauses, further comprising a second cushion extending from the anterior end to the posterior end and having a top side and a lower side formed on an opposite side of the second cushion than the top side, the lower side facing the upper side of the first cushion.

Clause 9. The sole structure of Clause 8, further comprising a plate disposed adjacent to the lower side and including a first plate portion attached to the first cushion in a toe portion, a second plate portion extending across the recess and attached to each of the first bladder and the second bladder, and a third plate portion attached to the first cushion in a mid-foot region of the sole structure.

Clause 10. The sole structure of any of the preceding Clauses, wherein the first bladder and the second bladder each include a tensile member.

Clause 11. A sole structure for an article of footwear, the sole structure comprising a cushion extending continuously from an anterior end of the sole structure to a posterior end of the sole structure and including a top side, a bottom side formed on an opposite side from the top side, and a receptacle disposed between the top side and the bottom side, a first bladder disposed within the receptacle adjacent to a lateral side of the sole structure, and a second bladder disposed within the receptacle adjacent to a medial side of the sole structure.

Clause 12. The sole structure of Clause 11, wherein the receptacle extends across an entire width of the cushion from the medial side to the lateral side.

Clause 13. The sole structure of any of the preceding Clauses, wherein the receptacle is disposed in a forefoot region of the cushion.

Clause 14. The sole structure of any of the preceding Clauses, wherein the receptacle extends from a first end surface adjacent to a toe portion of the sole structure to a second end surface disposed in one of a forefoot region or a mid-foot region of the sole structure.

Clause 15. The sole structure of Clause 14, wherein at least one of the first end surface or the second end surface is spaced apart from each of the first bladder and the second bladder.

Clause 16. The sole structure of Clause 14, wherein at least one of the first end surface and the second end surface is oriented at an oblique angle relative to a central axis of the first bladder.

Clause 17. The sole structure of Clause 16, wherein the first end surface is oriented at a first oblique angle relative to the central axis of the first bladder and the second end surface is oriented at a second oblique angle relative to the central axis.

Clause 18. The sole structure of any of the preceding Clauses, wherein the cushion includes a first cushion including a recess and a second cushion covering the recess to define the receptacle.

Clause 19. The sole structure of any of the preceding Clauses, further comprising a plate including a first plate portion attached to the cushion in a toe portion, a second plate portion extending across the receptacle and attached to each of the first bladder and the second bladder, and a third plate portion attached to the cushion in a mid-foot region of the sole structure.

Clause 20. The sole structure of any of the preceding Clauses, wherein the first bladder and the second bladder each include a tensile member.

Clause 21. A sole structure for an article of footwear, the sole structure comprising a first cushion extending continuously from an anterior end of the sole structure to a posterior end of the sole structure and including an upper side, a bottom side formed on an opposite side from the upper side, a recess formed in the upper side, and an upper peripheral locking member formed on the upper side in a heel region, a first bladder disposed within the recess adjacent to a lateral side of the sole structure, and a second bladder disposed within the recess adjacent to a medial side of the sole structure.

Clause 22. The sole structure of Clause 21, further comprising a second cushion extending from the anterior end to the posterior end and having a top side and a lower side formed on an opposite side of the second cushion than the top side, the lower side facing the upper side of the first cushion and including a lower peripheral locking member formed on the lower side and interfacing with the upper peripheral locking member.

Clause 23. The sole structure of Clause 22, wherein the upper peripheral locking member includes a plurality of upper locking elements disposed adjacent to a peripheral side on at least one of the medial side and the lateral side and the lower peripheral locking member includes a plurality of lower locking elements disposed adjacent to the peripheral side on the at least one of the medial side and the lateral side, the plurality of lower locking elements configured to mate with the plurality of upper locking elements.

Clause 24. The sole structure of Clause 22, further comprising a plate disposed adjacent to the lower side and including a first plate portion attached to the first cushion in a toe portion, a second plate portion extending across the recess and attached to each of the first bladder and the second bladder, and a third plate portion attached to the first cushion in a mid-foot region of the sole structure.

Clause 25. The sole structure of any of the preceding Clauses, wherein the recess extends across an entire width of the first cushion from the medial side to the lateral side.

Clause 26. The sole structure of any of the preceding Clauses, wherein the recess is disposed in a forefoot region of the first cushion.

Clause 27. The sole structure of any of the preceding Clauses, wherein the recess extends from a first end surface adjacent to a toe portion of the sole structure to a second end surface disposed in one of a forefoot region or a mid-foot region of the sole structure.

Clause 28. The sole structure of Clause 27, wherein at least one of the first end surface or the second end surface is spaced apart from each of the first bladder and the second bladder.

Clause 29. The sole structure of Clause 28, wherein the first cushion includes an opening extending through a thickness of the first cushion.

Clause 30. The sole structure of Clause 29, wherein the opening defines a notch formed in the second end surface of the first cushion.

Clause 31. A sole structure for an article of footwear, the sole structure comprising a cushion including a top side, a bottom side formed on an opposite side from the top side, a peripheral side extending from the top side to the bottom side and defining a substantially planar posterior wall oriented at a first oblique angle relative to a longitudinal axis of the article of footwear along a vertical direction and one or more bladders disposed within the cushion in a forefoot region of the sole structure.

Clause 32. The sole structure of Clause 31, wherein the posterior wall is oriented at a second oblique angle relative to the longitudinal axis of the article of footwear along a lateral direction.

Clause 33. The sole structure of any of the preceding Clauses, wherein the peripheral side includes a substantially straight upper peripheral surface and a substantially straight lower peripheral surface oriented at an oblique angle relative to the upper peripheral surface.

Clause 34. The sole structure of Clause 33, wherein the lower peripheral surface is angled outwardly relative to the vertical direction and the upper peripheral surface is angled inwardly relative to the vertical direction.

Clause 35. The sole structure of Clause 33, wherein the lower peripheral surface defines an increasing width of the cushion along a direction from the bottom side to the top side and the upper peripheral surface defines a tapering width of the cushion along the direction from the bottom side to the top side.

Clause 36. The sole structure of any of the preceding Clauses, wherein cushion includes a receptacle extending across an entire width of the cushion from a medial side to a lateral side, the one or more bladders disposed within the receptacle.

Clause 37. The sole structure of Clause 36, wherein the receptacle extends from a first end surface adjacent to a toe portion of the sole structure to a second end surface disposed in one of a forefoot region or a mid-foot region of the sole structure.

Clause 38. The sole structure of Clause 36, further comprising a plate including a first plate portion attached to the cushion in a toe portion, a second plate portion extending across the receptacle and attached to each of the one or more bladders, and a third plate portion attached to the cushion in a mid-foot region of the sole structure.

Clause 39. The sole structure of Clause 38, wherein the cushion includes a first cushion including a recess and a second cushion covering the recess to define the receptacle.

Clause 40. The sole structure of Clause 39, wherein the first cushion includes a first peripheral locking member disposed in a heel region and the second cushion includes a second peripheral locking member disposed in the heel region and mating with the first peripheral locking member on opposite sides of the plate.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a first compressible midsole layer formed as a monolithic structure and extending continuously from an anterior end of the sole structure to a posterior end of the sole structure, the first compressible midsole layer including an upper side, a bottom side formed on an opposite side from the upper side, and a recess formed in the upper side, the upper side including a first socket and a second socket each extending toward the bottom side;

a first bladder disposed within the recess adjacent to a lateral side of the sole structure and within the first socket; and a second bladder disposed within the recess adjacent to a medial side of the sole structure and within the second socket.

2. The sole structure of claim 1, wherein the recess extends across an entire width of the first compressible midsole layer from the medial side to the lateral side.

3. The sole structure of claim 1, wherein the recess is disposed in a forefoot region of the first compressible midsole layer.

4. The sole structure of claim 1, wherein the recess extends from a first end surface adjacent to a toe portion of the sole structure to a second end surface disposed in one of a forefoot region or a mid-foot region of the sole structure.

5. The sole structure of claim 4, wherein at least one of the first end surface or the second end surface is spaced apart from each of the first bladder and the second bladder.

6. The sole structure of claim 4, wherein at least one of the first end surface and the second end surface is oriented at an oblique angle relative to a central axis of the first bladder, the central axis extending through a thickness of the first bladder measured between a top side and a bottom side of the first bladder.

7. The sole structure of claim 6, wherein the first end surface is oriented at a first oblique angle relative to the central axis of the first bladder and the second end surface is oriented at a second oblique angle relative to the central axis.

8. The sole structure of claim 1, further comprising a second compressible midsole layer extending from the anterior end to the posterior end and having a top side and a lower side formed on an opposite side of the second compressible midsole layer than the top side, the lower side facing the upper side of the first compressible midsole layer.

9. The sole structure of claim 8, further comprising a plate disposed adjacent to the lower side and including a first plate portion attached to the first compressible midsole layer in a toe portion, a second plate portion extending across the recess and attached to each of the first bladder and the second bladder, and a third plate portion attached to the first compressible midsole layer in a mid-foot region of the sole structure.

10. The sole structure of claim 1, wherein the first bladder and the second bladder each include a tensile member.

11. A sole structure for an article of footwear, the sole structure comprising:

a compressible midsole layer formed as a monolithic structure and extending continuously from an anterior end of the sole structure to a posterior end of the sole structure the compressible midsole layer including:

a top side including a first wall facing the posterior end, a second wall spaced from the first wall and facing the anterior end, and a support wall extending continuously between the first wall and the second wall, the support wall including a pair of sockets, a bottom side formed on an opposite side from the top side, and a receptacle disposed between the first wall, the second wall, and the support wall;

a first bladder disposed in a first socket of the pair of sockets and within the receptacle adjacent to a lateral side of the sole structure; and a second bladder disposed in a second socket of the pair of sockets and within the receptacle adjacent to a medial side of the sole structure.

12. The sole structure of claim 11, wherein the receptacle extends across an entire width of the compressible midsole layer from the medial side to the lateral side.

13. The sole structure of claim 11, wherein the receptacle is disposed in a forefoot region of the compressible midsole layer.

14. The sole structure of claim 11, wherein the receptacle extends from a first end surface adjacent to a toe portion of the sole structure to a second end surface disposed in one of a forefoot region or a mid-foot region of the sole structure.

15. The sole structure of claim 14, wherein at least one of the first end surface or the second end surface is spaced apart from each of the first bladder and the second bladder.

16. The sole structure of claim 14, wherein at least one of the first end surface and the second end surface is oriented at an oblique angle relative to a central axis of the first bladder, the central axis extending through a thickness of the first bladder measured between a top side and a bottom side of the first bladder.

17. The sole structure of claim 16, wherein the first end surface is oriented at a first oblique angle relative to the central axis of the first bladder and the second end surface is oriented at a second oblique angle relative to the central axis.

18. The sole structure of claim 11, wherein the compressible midsole layer includes a first cushion including a recess and a second cushion covering the recess to define the receptacle.

19. The sole structure of claim 11, further comprising a plate including a first plate portion attached to the compressible midsole layer in a toe portion, a second plate portion extending across the receptacle and attached to each of the first bladder and the second bladder, and a third plate portion attached to the compressible midsole layer in a mid-foot region of the sole structure.

20. The sole structure of claim 11, wherein the first bladder and the second bladder each include a tensile member.

* * * * *